US012279682B1

(12) United States Patent
Li et al.

(10) Patent No.: US 12,279,682 B1
(45) Date of Patent: Apr. 22, 2025

(54) STORAGE BOX

(71) Applicant: Shantou Lansibaidi Clothing Co., Ltd., Shantou (CN)

(72) Inventors: Jialin Li, Shantou (CN); Jieya Wang, Shantou (CN)

(73) Assignee: Shantou Lansibaidi Clothing Co., Ltd., Shantou (CN)

( * ) Notice: Subject to any disclaimer, the term of this patent is extended or adjusted under 35 U.S.C. 154(b) by 0 days.

(21) Appl. No.: 18/961,290

(22) Filed: Nov. 26, 2024

Related U.S. Application Data

(63) Continuation of application No. PCT/CN2023/141341, filed on Dec. 25, 2023.

(51) Int. Cl.
*A45C 13/03* (2006.01)
*A45C 5/08* (2006.01)

(52) U.S. Cl.
CPC ..... *A45C 13/03* (2013.01); *A45C 5/08* (2013.01)

(58) Field of Classification Search
CPC . E05D 3/04; E05D 2005/106; E05D 11/1007; E05D 2011/1032; Y10S 203/804; A45C 13/03; A45C 5/08; A45C 11/10; A45C 11/16
USPC .... 16/374, 353, 365, 386; 206/216, 749, 18, 206/755, 559, 572; 312/269
See application file for complete search history.

(56) References Cited

U.S. PATENT DOCUMENTS 2,880,858 A * 4/1959 Persky ..... A45C 11/10 206/755
4,778,047 A * 10/1988 Lay ..... G11B 33/0444
4,802,575 A * 2/1989 Martin ..... A45C 13/02 206/214
4,863,025 A * 9/1989 Wolf ..... G11B 23/0233 206/387.1
5,176,250 A * 1/1993 Cheng ..... G11B 33/045 206/755
5,597,068 A * 1/1997 Weisburn ..... E05B 73/0023
6,024,215 A * 2/2000 Leung ..... G11B 33/0444
6,062,385 A * 5/2000 Cho ..... A45C 3/02 220/819

(Continued)

FOREIGN PATENT DOCUMENTS

CN 202063421 U 12/2011
CN 203006081 U 6/2013

(Continued)

*Primary Examiner* — Chun Hoi Cheung
(74) *Attorney, Agent, or Firm* — Westbridge IP LLC

(57) ABSTRACT

A storage box includes an upper cover, a lower cover, a drying support member and a shaft sleeve mechanism. The shaft sleeve mechanism includes a key shaft, an upper cover shaft sleeve, a lower cover shaft sleeve and an drying support member shaft sleeve matched with the key shaft, and the key shaft includes a lower cover shaft sleeve adaptation section, an upper cover shaft sleeve adaptation section and a drying support member shaft sleeve adaptation section. The upper cover is rotatably connected to the upper cover shaft sleeve adaptation section of the key shaft, the lower cover is rotatably connected to the lower cover shaft sleeve adaptation section of the key shaft, the drying support member is connected to the drying support member shaft sleeve adaptation section of the key shaft, and the drying support member and the key shaft rotate synchronously.

17 Claims, 16 Drawing Sheets

(56) References Cited

U.S. PATENT DOCUMENTS

| | | | | |
|---|---|---|---|---|
| 7,021,464 | B2 * | 4/2006 | Chen | B25H 3/003 206/743 |
| 10,247,230 | B2 * | 4/2019 | McCullough | F16C 11/10 |
| 2004/0026275 | A1 * | 2/2004 | Margetts | G11B 33/0422 |
| 2005/0224376 | A1 | 10/2005 | Chen | |
| 2014/0190849 | A1 * | 7/2014 | Williams | F41A 29/02 206/231 |
| 2015/0257562 | A1 * | 9/2015 | Miksovsky | B67B 7/16 206/553 |
| 2018/0255892 | A1 | 9/2018 | Cardenas | |

FOREIGN PATENT DOCUMENTS

| | | | |
|---|---|---|---|
| CN | 203143357 | U | 8/2013 |
| CN | 106241025 | A | 12/2016 |
| CN | 212670085 | U | 3/2021 |

* cited by examiner

B-B

STORAGE BOX

CROSS-REFERENCE TO RELATED APPLICATIONS

This application is a continuation of International Application No. PCT/CN2023/141341, filed on Dec. 25, 2023, the content of which is incorporated herein by reference in its entirety.

TECHNICAL FIELD

The present disclosure belongs to the field of storage boxes, and specifically relates to a storage box for personal private items such as breast pasties, underwear, or other personal private items.

BACKGROUND

Existing storage boxes, particularly those designed for storing personal items such as breast pasties, underwear, or other private articles, generally suffer from the following issues.

Firstly, these storage boxes are only used for storing items, and their function is single. Secondly, after use, breast pasties may have sweat, dust, hairs, bacteria, and other contaminants attached to them. Cleaning is required after use, and if not cleaned promptly, the stickiness of the breast pasties will be significantly reduced. Generally, breast pasties need to be dried before they can be stored in the storage box, but existing storage boxes do not have a drying function, requiring users to find a hanger or a suitable place to dry the breast pasties. Thirdly, as breast pasties are personal items for intimate areas of women, it is unhygienic to dry them without a dedicated hanger. Lastly, if the breast pasties are placed in an inappropriate position or angle after cleaning, water droplets may easily remain on the surface, making it difficult to dry.

SUMMARY

In order to solve the above technical problems, the present disclosure provides a storage box, comprising an upper cover and a lower cover, wherein the storage box further comprises a drying support member and a shaft sleeve mechanism, and the shaft sleeve mechanism comprises a key shaft, an upper cover shaft sleeve, a lower cover shaft sleeve and a drying support member shaft sleeve; the upper cover shaft sleeve, the lower cover shaft sleeve and the drying support member shaft sleeve are matched with the key shaft, the key shaft comprises a lower cover shaft sleeve adaptation section, an upper cover shaft sleeve adaptation section and a drying support member shaft sleeve adaptation section, the lower cover shaft sleeve adaptation section is matched with the lower cover shaft sleeve, the upper cover shaft sleeve adaptation section is matched with the upper cover shaft sleeve, and the drying support member shaft sleeve adaptation section is matched with the drying support member shaft sleeve; the upper cover is provided with the upper cover shaft sleeve, the upper cover is rotatably connected to the upper cover shaft sleeve adaptation section of the key shaft via the upper cover shaft sleeve, the lower cover is provided with the lower cover shaft sleeve, the lower cover is rotatably connected to the lower cover shaft sleeve adaptation section of the key shaft via the lower cover shaft sleeve, the drying support member is provided with the drying support member shaft sleeve, the drying support member is connected to the drying support member shaft sleeve adaptation section of the key shaft via the drying support member shaft sleeve, and the drying support member and the key shaft rotate synchronously; when the storage box is in a closed position, the drying support member is located between the upper cover and the lower cover, and an upper end of the drying support member is connected with the upper cover, and a lower end of the drying support member is connected with the lower cover; and when the drying support member is in a working state, the drying support member is vertically supported on the storage box.

Further, an upper cover shaft hole matched with the key shaft is formed in the upper cover shaft sleeve, an upper key shaft avoiding hole coaxial with the upper cover shaft hole is further formed in the upper cover shaft sleeve, and an upper first rotation limiting portion and an upper second rotation limiting portion are formed in the upper key shaft avoiding hole; a lower cover shaft hole matched with the key shaft is formed in the lower cover shaft sleeve, a lower key shaft avoiding hole coaxial with the lower cover shaft hole is further formed in the lower cover shaft sleeve, and a lower first rotation limiting portion and a lower second rotation limiting portion are formed in the lower key shaft avoiding hole; and a drying support member shaft hole matched with the key shaft is formed in the drying support member shaft sleeve.

Further, an inner wall of the upper cover shaft hole is provided with an upper cover key groove, an inner wall of the lower cover shaft hole is provided with a lower cover key groove, and an inner wall of the drying support member shaft hole is provided with a plurality of drying support member key grooves.

Further, the upper first rotation limiting portion is located at a position of 0 degrees in a circumferential direction of the upper key shaft avoiding hole, and the upper second rotation limiting portion is located at a position of 180 degrees in the circumferential direction of the upper key shaft avoiding hole; the lower first rotation limiting portion is located at a position of 0 degrees in a circumferential direction of the lower key shaft avoiding hole, and the lower second rotation limiting portion is located at a position of 180 degrees in the circumferential direction of the lower key shaft avoiding hole; the upper cover key groove is located at a position of 270 degrees in a circumferential direction of the upper cover shaft hole, and the lower cover key groove is located at a position of 90 degrees in the circumferential direction of the lower cover shaft hole; a number of the drying support member key grooves is three, the three drying support member key grooves are located at positions of 90 degrees, 180 degrees and 270 degrees in a circumferential direction of the drying support member shaft hole respectively; or, a number of the drying support member key grooves is four, the four drying support member key grooves are located at positions of 90 degrees, 180 degrees, 270 degrees and 0 degrees in the circumferential direction of the drying support member shaft hole respectively.

Further, the lower cover shaft sleeve comprises an outer lower cover shaft sleeve, and correspondingly, the lower cover shaft sleeve adaptation section comprises an outer lower cover shaft sleeve adaptation section matched with the outer lower cover shaft sleeve, the outer lower cover shaft sleeve adaptation section is provided with an outer lower cover key, a number of the outer lower cover key is two, the two outer lower cover keys are used for being matched with the outer lower cover shaft sleeve, and the two outer lower cover keys are respectively a first outer lower cover key and a second outer lower cover key; the upper cover shaft sleeve adaptation section is provided with an upper cover key, a number of the upper cover key is two, the two upper cover keys are used for being matched with the upper cover shaft sleeve, and the two upper cover keys are respectively a first upper cover key and a second upper cover key; and the drying support member shaft sleeve adaptation section is provided with at least one drying support member key, and the drying support member key is used for being matched with the drying support member shaft sleeve.

Further, the first outer lower cover key is located at a position of 180 degrees in a circumferential direction of the key shaft, and the second outer lower cover key is located at a position of 270 degrees in the circumferential direction of the key shaft; the first upper cover key is located at a position of 90 degrees in the circumferential direction of the key shaft, and the second upper cover key is located at a position of 180 degrees in the circumferential direction of the key shaft; and at least one of the drying support member key is provided on the drying support member shaft sleeve adaptation section, located at the circumferential positions of 90 degrees, 180 degrees, 270 degrees, or 0 degrees of the key shaft.

Further, the lower cover shaft sleeve further comprises an inner lower cover shaft sleeve, and the key shaft further comprises an inner lower cover shaft sleeve adaptation section matched with the inner lower cover shaft sleeve.

Further, the inner lower cover shaft sleeve adaptation section is provided with an inner lower cover key, and the inner lower cover key is located at the position of 270 degrees in the circumferential direction of the key shaft.

Further, the key shaft further comprises a handle adaptation section, and the storage box further comprises a handle; and the handle is provided with a handle shaft sleeve, the handle shaft sleeve is rotatably connected to the handle adaptation section, a handle shaft hole matched with the handle adaptation section is formed in the handle shaft sleeve, and an inner side wall of the handle shaft hole is provided with a plurality of handle key grooves.

Further, when the storage box is completely opened and the drying support member is in a supporting state, the handle is located in a gap between the upper cover and the lower cover, and a set distance is arranged between an end surface of a free end of the handle and either an end surface of the upper cover or an end surface of the lower cover.

Further, a suspension portion is provided at one end of the drying support member away from the drying support member shaft sleeve.

Further, the suspension portion is a flat-bottomed groove, and the flat-bottomed groove is formed by recessing a surface of the drying support member.

Further, the upper cover further comprises an upper cover body, the upper cover shaft sleeve is provided on the upper cover body, the lower cover further comprises a lower cover body, the lower cover shaft sleeve is provided on the lower cover body, the drying support member further comprises a drying support member body, and the drying support member shaft sleeve is provided on the drying support member body.

Further, an upper cover opening end surface is formed on the upper cover body, an upper cover connecting portion is formed on a surface of the upper cover opening end surface, and the upper cover connecting portion is used for being matched with the drying support member body; a lower cover opening end surface is formed on the lower cover body, a lower cover connecting portion is formed on a surface of the lower cover opening end surface, and the lower cover connecting portion is used for being matched with the drying support member body; a drying support member upper end surface is formed on the drying support member body, and the drying support member upper end surface is matched with the upper cover opening end surface; and a drying support member lower end surface is further formed on the drying support member body, and the drying support member lower end surface is matched with the lower cover opening end surface.

Further, the upper cover connecting portion is formed by protruding out of an outer side surface of the upper cover opening end surface, and a shape of the upper cover connecting portion is a stepped boss; correspondingly, a drying support member upper connecting portion is formed by recessing an outer side surface of the drying support member upper end surface, and a shape of the drying support member upper connecting portion is a stepped sinking table; the lower cover connecting portion is formed by protruding out of an outer side surface of the lower cover opening end surface, and a shape of the lower cover connecting portion is a stepped boss; correspondingly, a drying support member lower connecting portion is formed by recessing an outer side surface of the drying support member lower end surface, and a shape of the drying support member lower connecting portion is a stepped sinking table.

Further, the upper cover connecting portion comprises an upper cover connecting portion closing surface and an upper cover connecting portion transition surface, and the upper cover connecting portion transition surface is connected to the upper cover connecting portion closing surface and the upper cover opening end surface; the drying support member upper connecting portion comprises a drying support member upper connecting portion closing surface and a drying support member upper connecting portion transition surface, and the drying support member upper connecting portion transition surface is connected to the drying support member upper connecting portion closing surface and the drying support member upper end surface; the lower cover connecting portion comprises a lower cover connecting portion closing surface and a lower cover connecting portion transition surface, and the lower cover connecting portion transition surface is connected to the lower cover connecting portion closing surface and the lower cover opening end surface; and the drying support member lower connecting portion comprises a drying support member lower connecting portion closing surface and a drying support member lower connecting portion transition surface, and the drying support member lower connecting portion transition surface is connected to the drying support member lower connecting portion closing surface and the drying support member lower end surface.

Further, the storage box further comprises a lock box mechanism, the lock box mechanism comprises a lock cover buckling portion, a lock cover and a lock cover rotating shaft portion, the lock cover buckling portion is provided on the upper cover, the lock cover rotating shaft portion is provided on the lower cover, and the lock cover is rotatably connected to the lower cover via the lock cover rotating shaft portion; and the lock cover rotating shaft portion is provided with a lock cover rotating shaft, a lower portion of the lock cover is provided with a lock cover rotating shaft hole matched with the lock cover rotating shaft, and an upper portion of the lock cover is provided with a lock cover buckle matched with the lock cover buckling portion.

The storage box of the present disclosure has the following advantages or beneficial effects.

Firstly, in addition to its normal storage function, this storage box also features multiple functions such as drying and supporting. Breast pasties that have been used or cleaned can be hung vertically on the drying support member, facilitating quick drying.

Secondly, after cleaning, there is no need to look for another hanger to dry the breast pasties. By opening the drying support member of the storage box, it can be used to dry the breast pasties, making it convenient to use and not occupying space.

Thirdly, using the drying support device built into the storage box for drying can serve as a personal exclusive hanger, ensuring cleanliness and hygiene. At the same time, when the breast pasties are supported on the drying support member, any residual water droplets on their surface can flow into the storage box and be easily discarded, preventing the drying area from getting wet or dirty.

Fourthly, the drying support member is cleverly cooperated with the shaft sleeve mechanism, as well as the upper cover and the lower cover, to stand upright and be supported on the storage box. As the drying support member must rotate synchronously with either the upper cover or the lower cover when returning to its original position, the upper cover and the lower cover, due to their own weight, create a certain moment arm and torque with the key shaft. Furthermore, the rotation limiting portion inside the shaft sleeve mechanism and the keys on the corresponding adaptation section of the drying support member provide resistance, preventing the key shaft from rotating easily, and consequently, the drying support member from rotating easily. When the drying support member is in its working state and standing upright on the storage box, it will not easily fall over. This rotating support structure of the drying support member is compact, ingenious, stable, and reliable.

Fifthly, if the angle between the upper cover and the lower cover does not exceed 90 degrees when opening the storage box, the drying support member remains in its closed position, which does not interfere with the removal or placement of breast pasties or other items.

Lastly, the drying support member of the storage box shares one key shaft with the upper cover and the lower cover, and the drying support member is integrated with the upper cover and the lower cover of the storage box, making the entire structure of the storage box compact, ingenious, stable, and reliable.

BRIEF DESCRIPTION OF THE DRAWINGS

In order to more clearly illustrate the embodiments of the present disclosure or the technical solutions in the prior art, the drawings required in the description of the embodiments or the prior art will be briefly described below. Obviously, the drawings in the following description are merely some embodiments of the present disclosure, and for those of ordinary skill in the art, other drawings may be obtained according to these drawings without creative efforts.

DETAILED DESCRIPTION OF THE EMBODIMENTS

Figure 1:
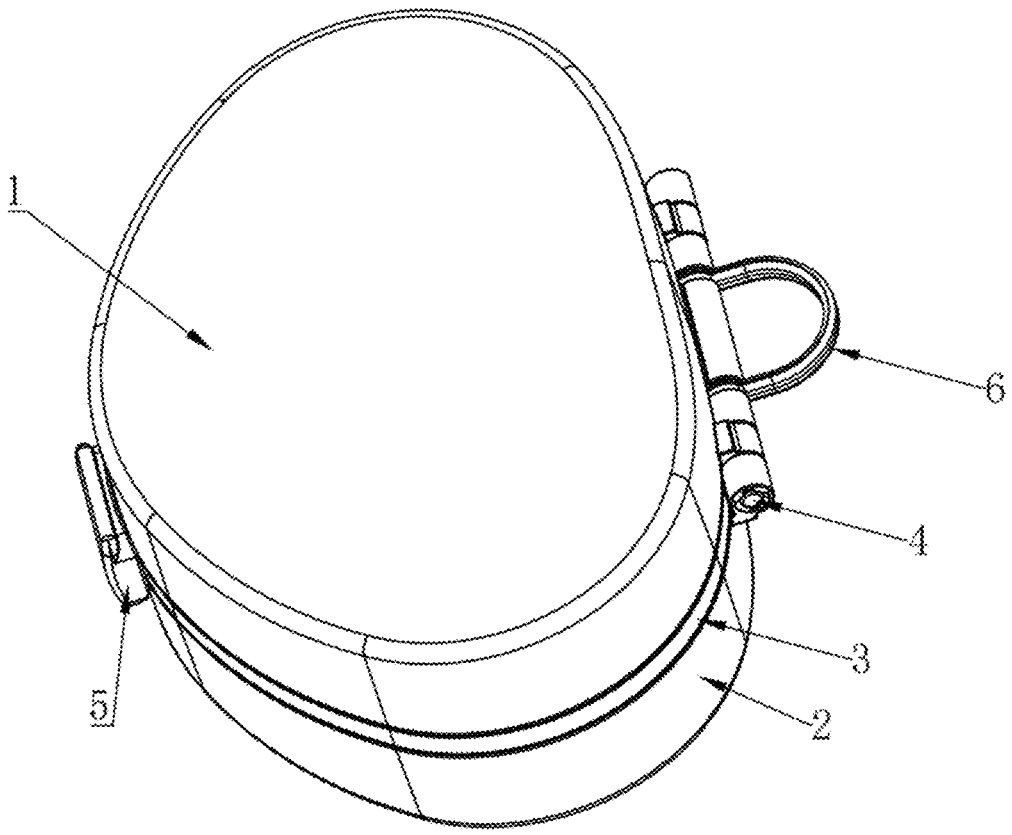
FIG. 1 is a schematic diagram of a first three-dimensional state of a storage box according to the present disclosure.
Figure 2:
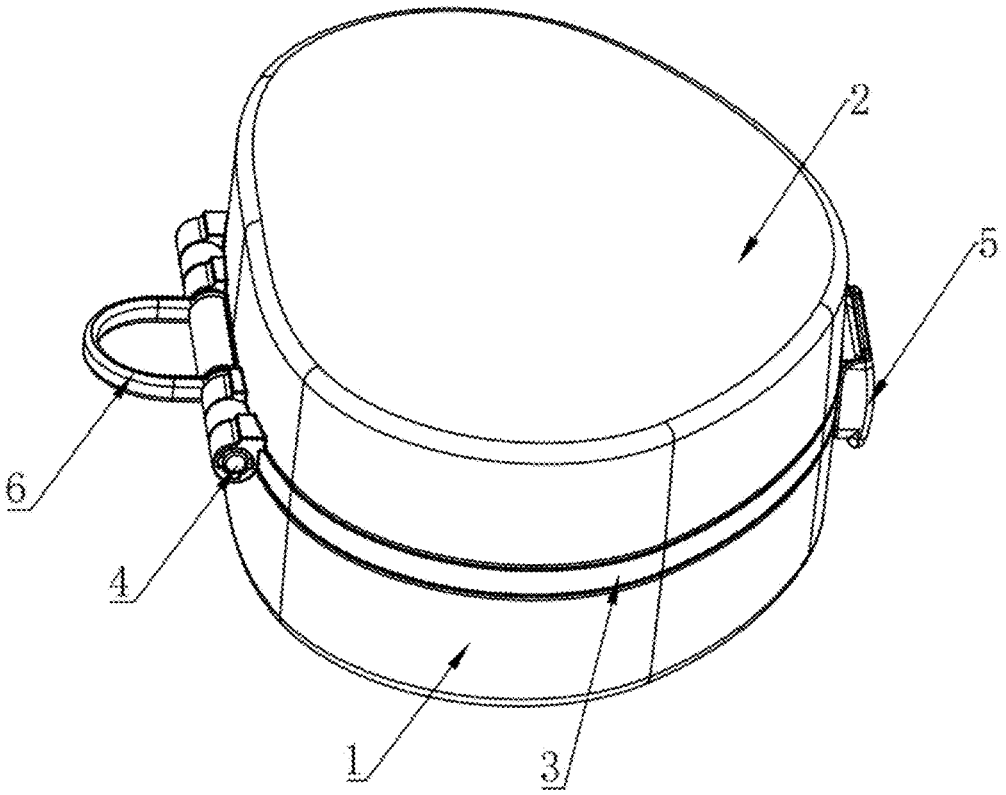
FIG. 2 is a schematic diagram of a second three-dimensional state of a storage box according to the present disclosure.

In view of the problems existing in the prior art, the present disclosure provides a storage box to solve the above technical problems.

In view of the above technical problems, the technical solution will be further elaborated below in combination with specific embodiments.

The embodiment of the present disclosure provides a storage box. For details, see FIG. 1 to FIG. 19 of the accompanying drawings.

The storage box of the embodiment comprises an upper cover 1 and a lower cover 2, the upper cover 1 comprises an upper cover body 11 and an upper cover shaft sleeve 12, the upper cover shaft sleeve 12 is arranged on one side of the upper cover body 11, the upper cover shaft sleeve 12 is fixedly connected with the upper cover body 11 or integrally formed with the upper cover body 11, and the upper cover body 11 is sleeved on the key shaft 41 via the upper cover shaft sleeve 12.

An upper cover shaft hole 121 matched with a shaft body 410 of the key shaft 41 (in this embodiment, the circumferential angles of the key shaft 41, and the upper cover shaft hole 121, the lower cover shaft hole 221, the upper key shaft avoiding hole 123, the lower key shaft avoiding hole 223, and other circular or cylindrical components or parts described below, all use the perspective state of the product shown in FIG. 3, 4, or 17 as the angular reference.

Figure 3:
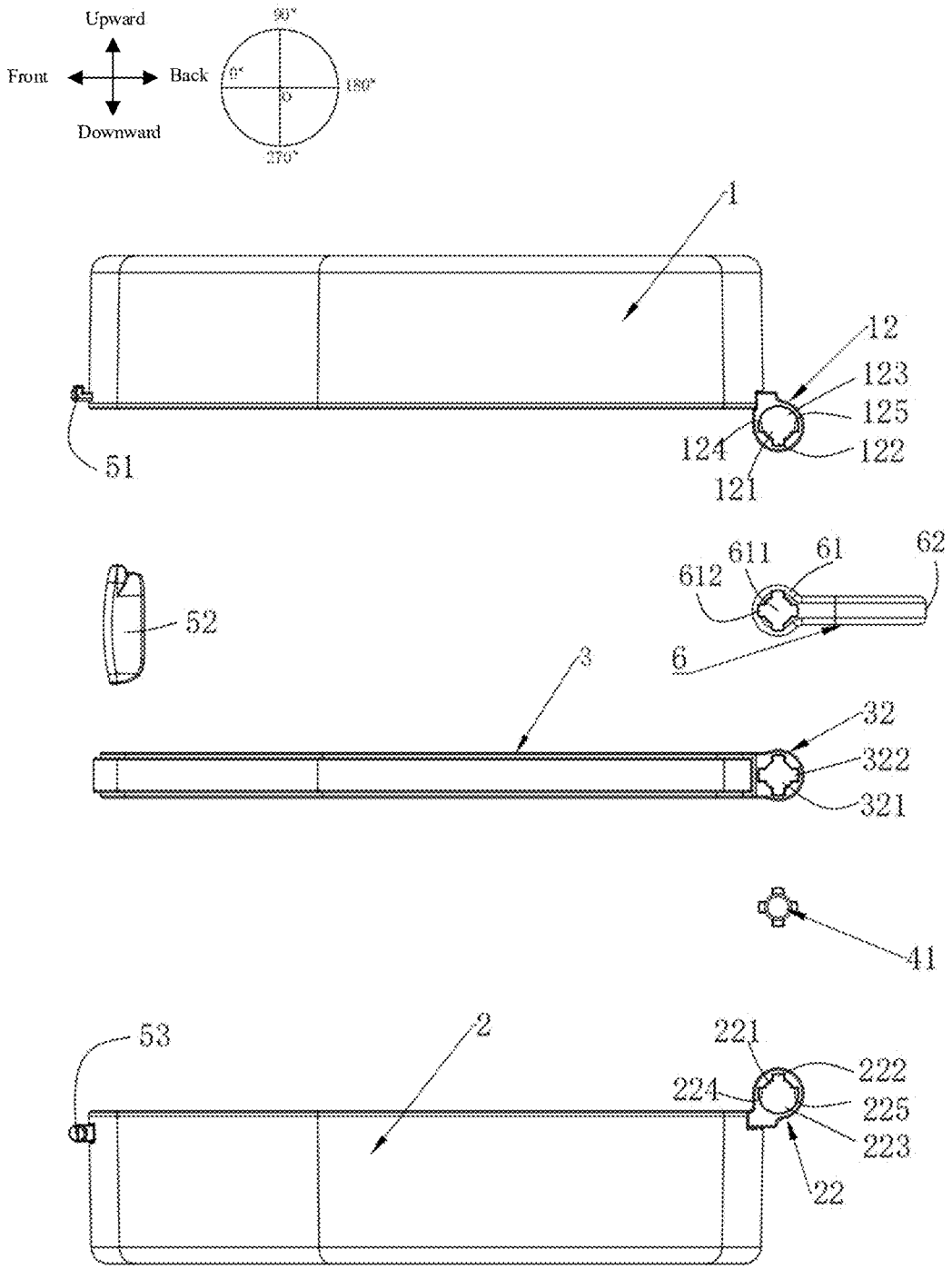
FIG. 3 is a schematic diagram of a first explosion state of a storage box according to the present disclosure.
Figure 4:
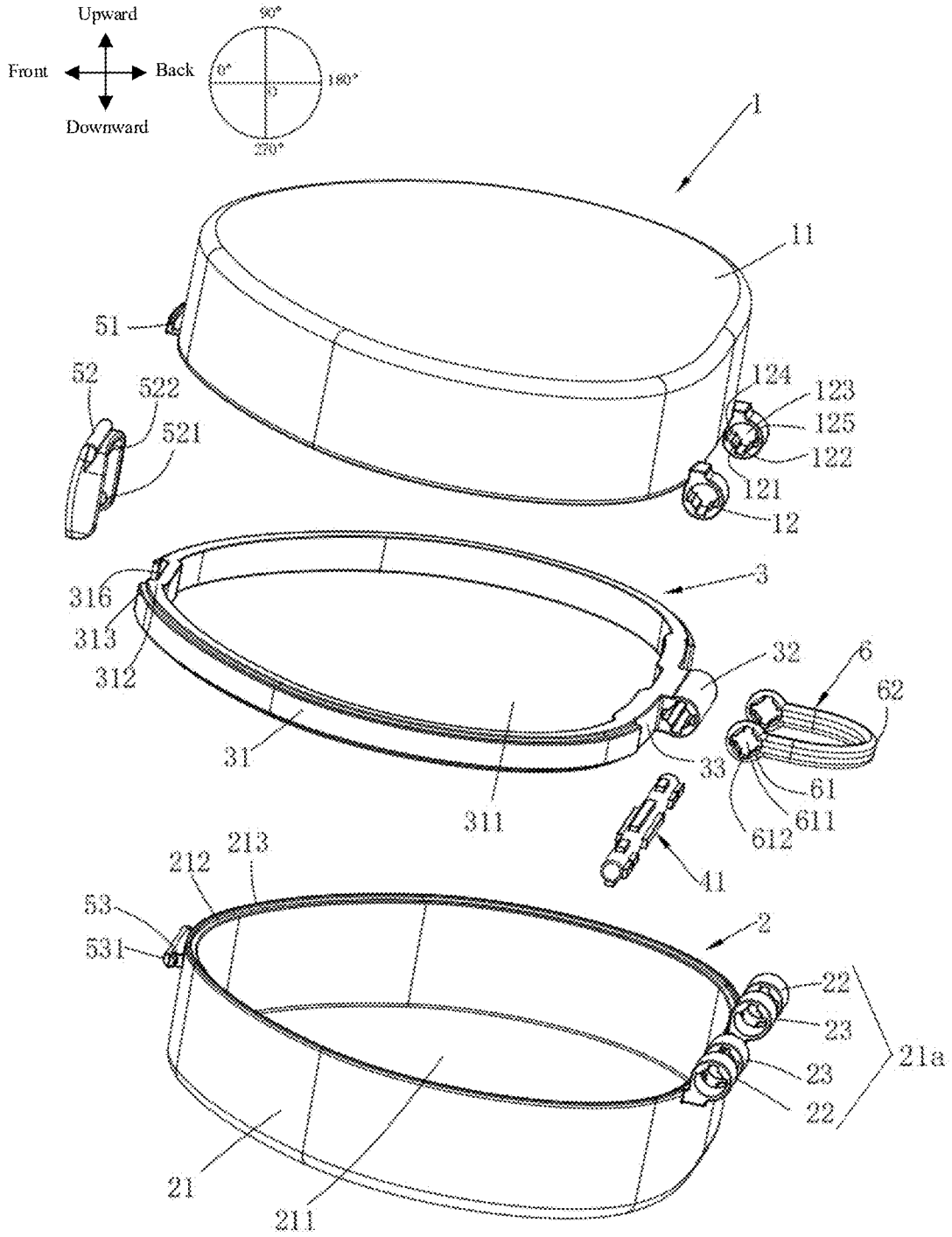
FIG. 4 is a schematic diagram of a second explosion state of a storage box according to the present disclosure.
Figure 5:
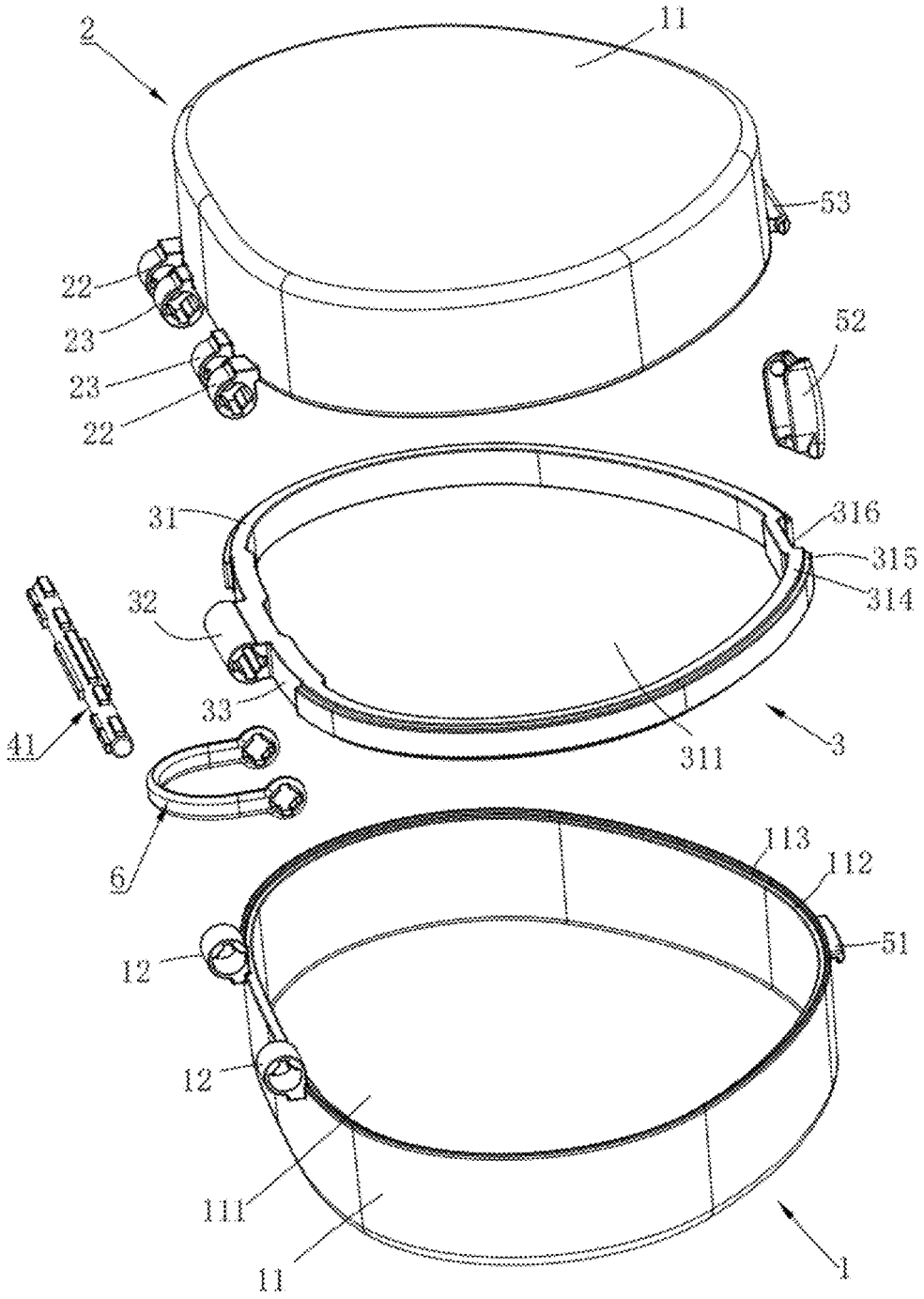
FIG. 5 is a schematic diagram of a third explosion state of a storage box according to the present disclosure.
Figure 6:
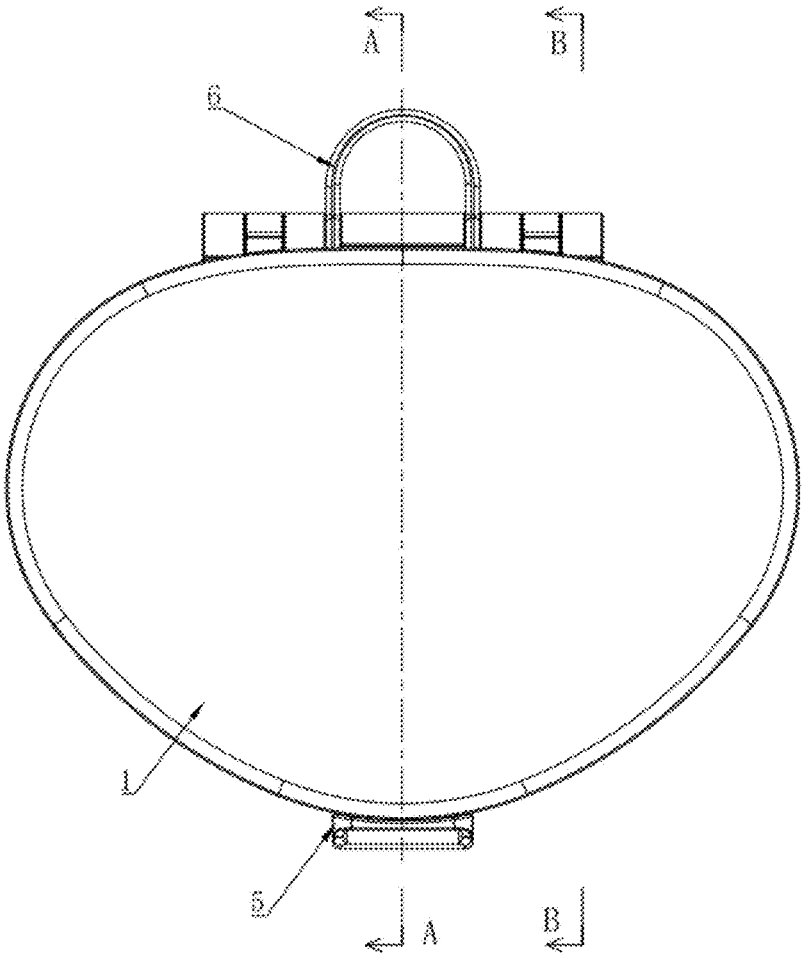
FIG. 6 is a front view of a storage box according to the present disclosure.
Figure 7:
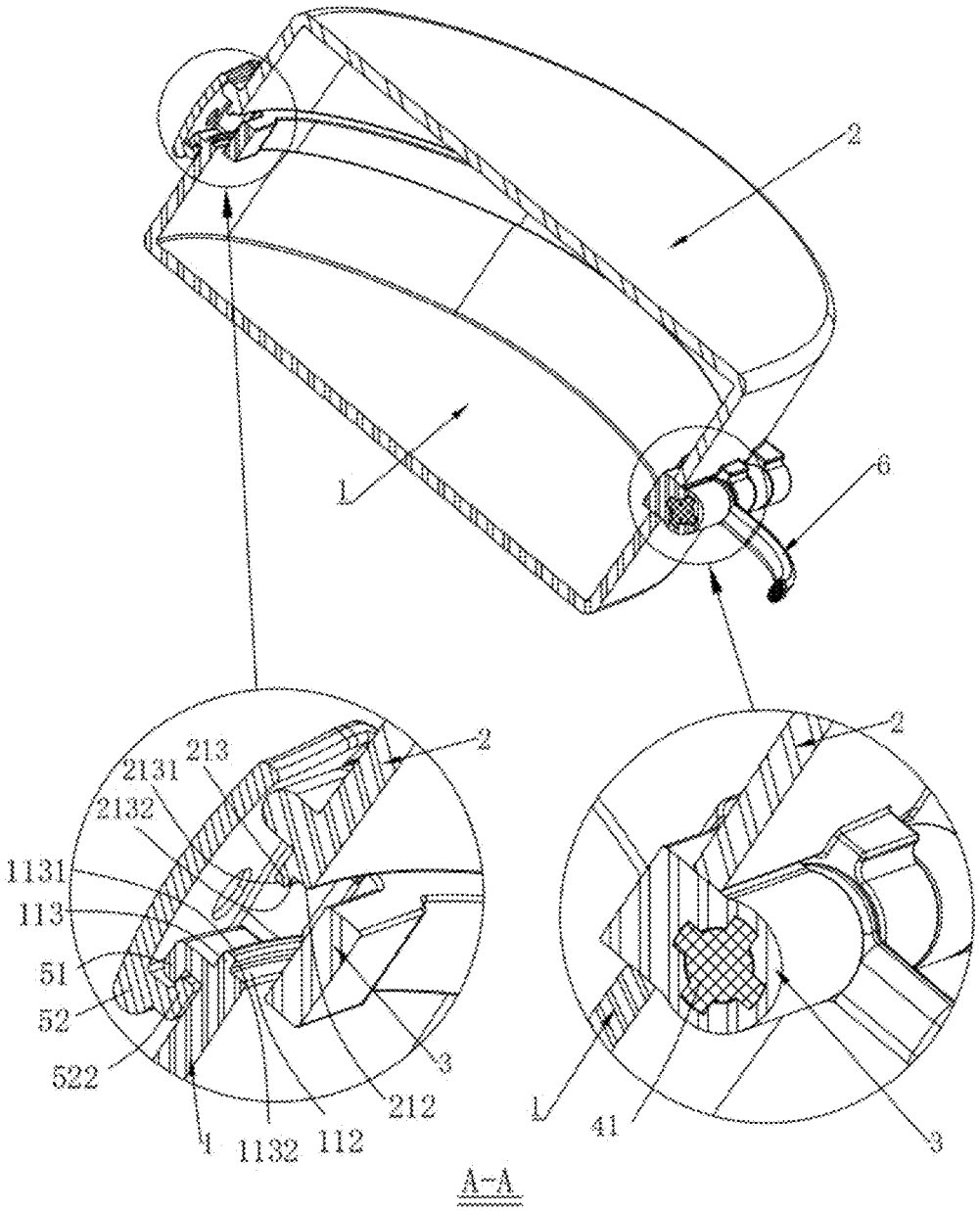
FIG. 7 is a three-dimensional view of the A-A section in FIG. 6, with partial enlarged views in the circled areas.
Figure 8:
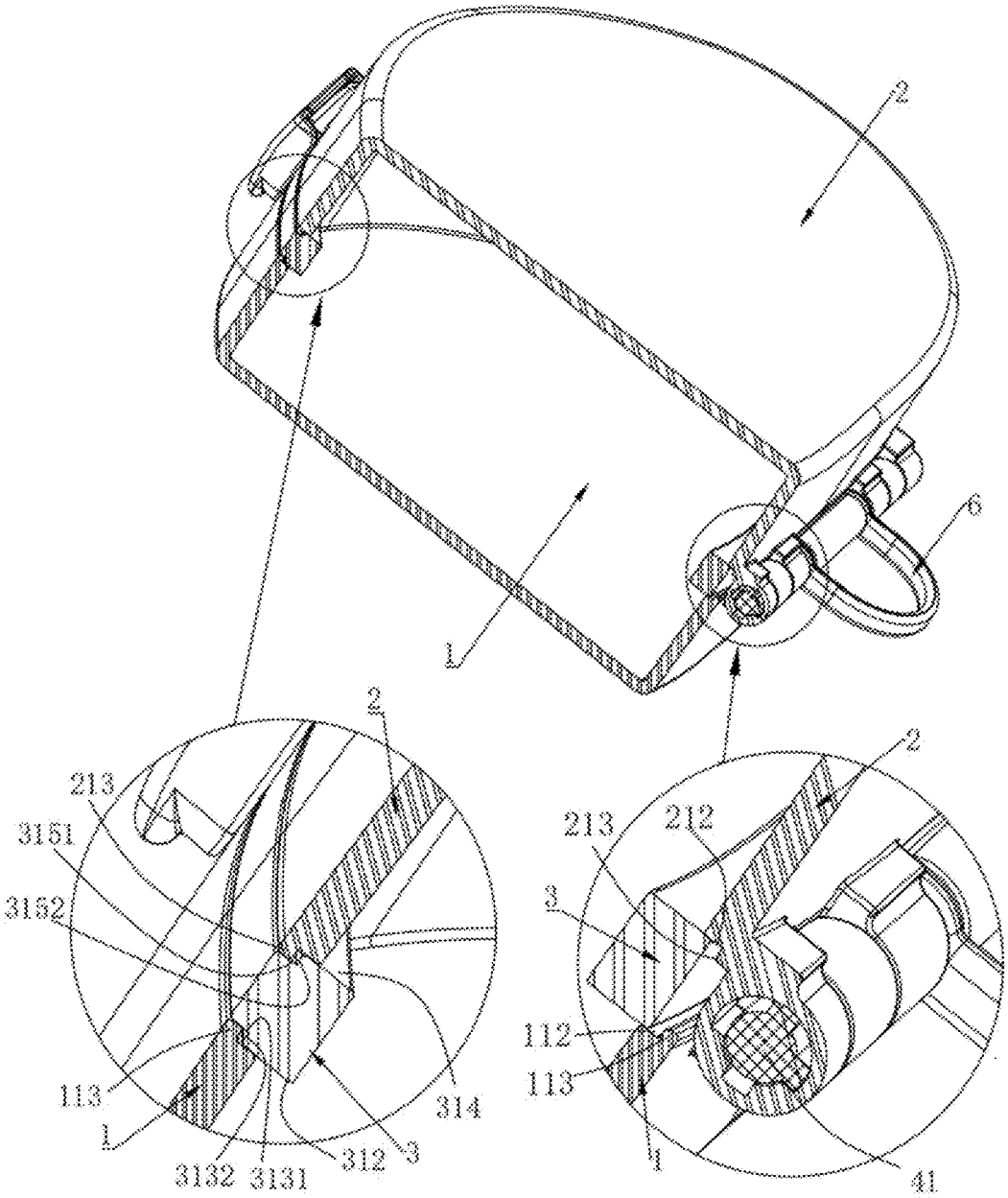
FIG. 8 is a three-dimensional view of the B-B section in FIG. 6, with partial enlarged views in the circled areas.
Figure 9:
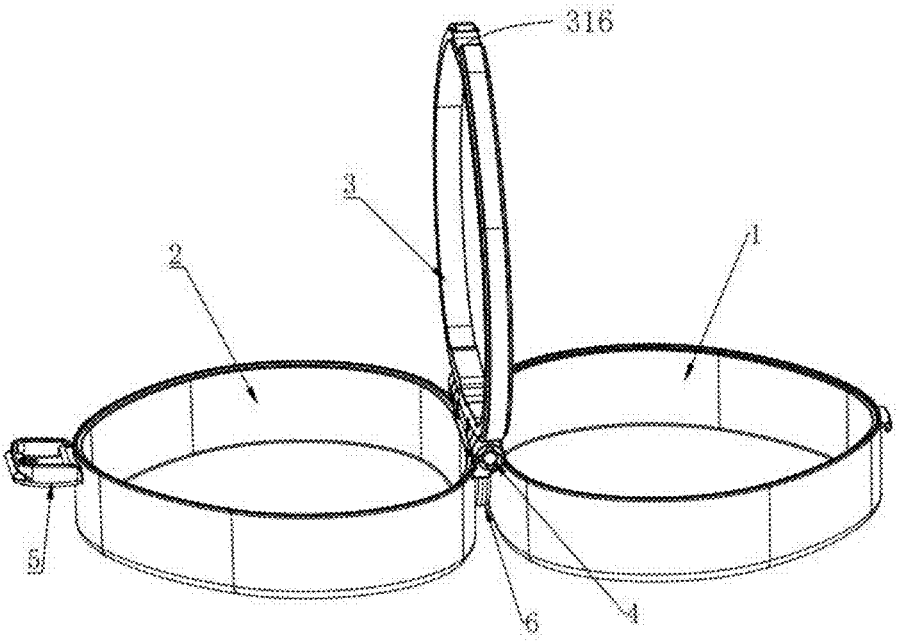
FIG. 9 is a three-dimensional view of a drying support member in a working state of a storage box according to the present disclosure.
Figure 10:
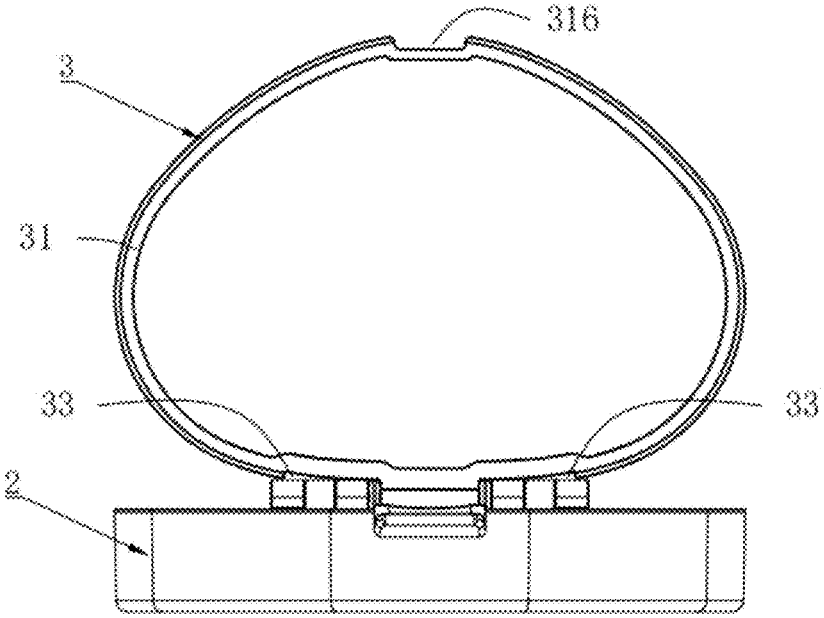
FIG. 10 is a front view of a drying support member in a working state of a storage box according to the present disclosure.
Figure 11:
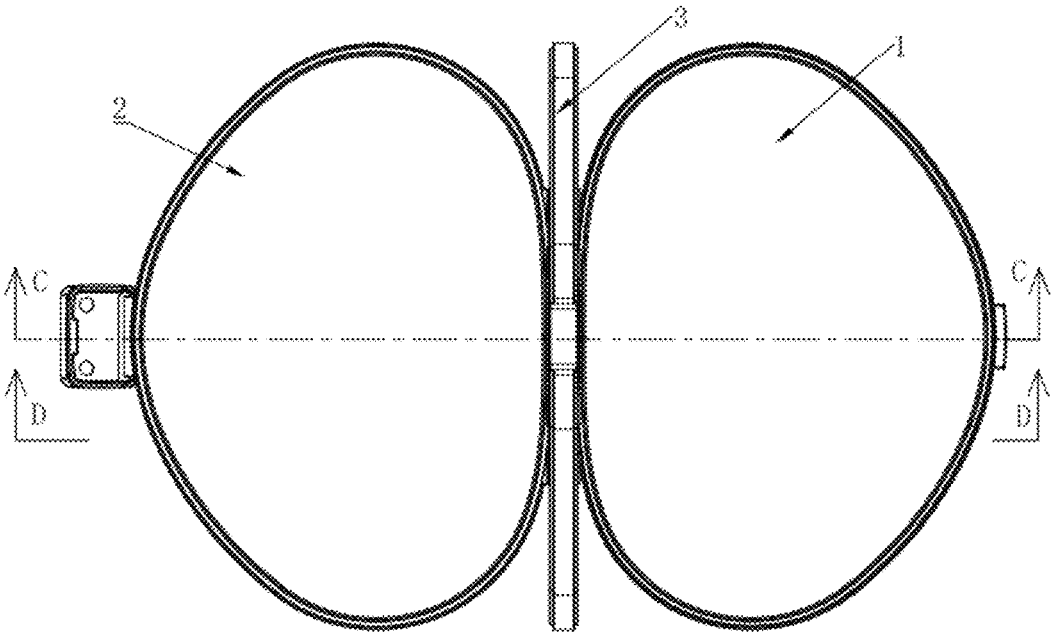
FIG. 11 is a top view of a drying support member in a working state of a storage box according to the present disclosure.
Figure 17:
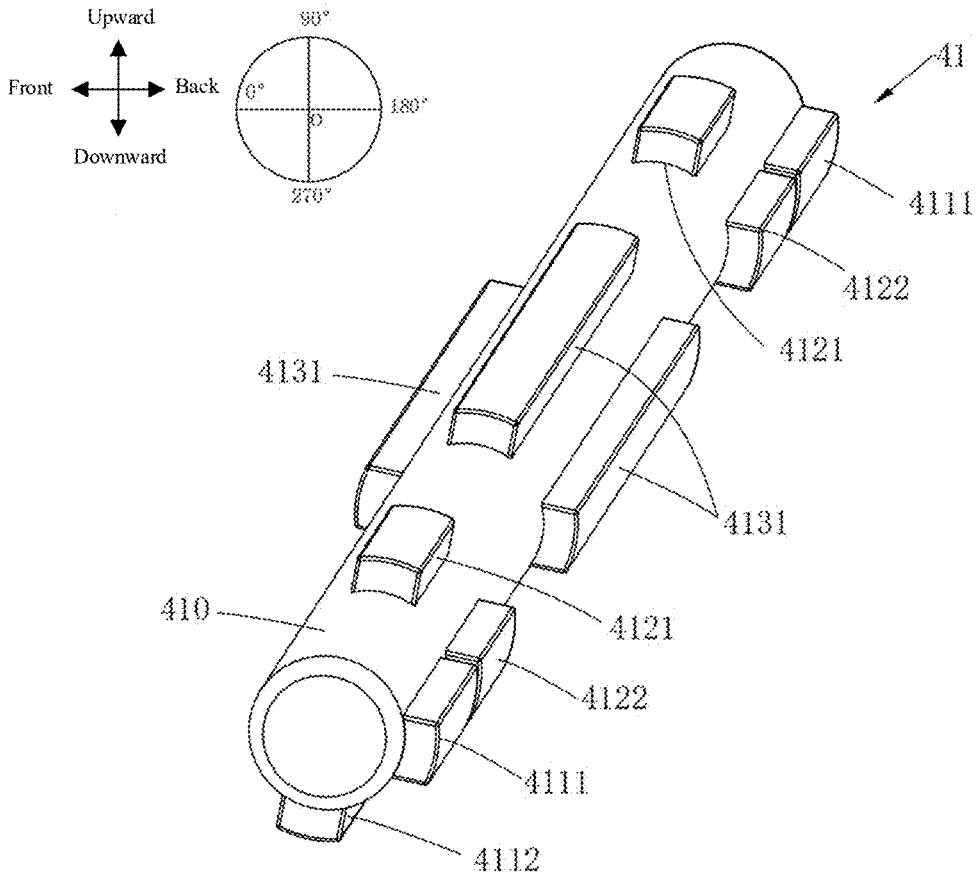
FIG. 17 is a first three-dimensional view of the key shaft of the storage box according to the present disclosure.

The positions of 0 degrees, 90 degrees, 180 degrees, and 270 degrees around the circumference are indicated in the top left corner of FIG. 3, 4, or 17 is formed in the upper cover shaft sleeve 12, so that the upper cover body 11 is rotatably connected with the key shaft 41.

An upper cover key groove 122 is formed in an inner wall of the upper cover shaft hole 121 in the circumferential 270 degree position of the upper cover shaft hole 121, the upper cover key groove 122 is communicated with the upper cover shaft hole 121, the upper cover key groove 122 is used for allowing a key at the 270 degree circumferential position of the key shaft 41 to pass through when the key shaft 41 is installed or removed, the upper cover key groove 122 is enclosed by two side walls and one top wall, the top wall of the upper cover key groove 122 is a part of the inner wall of one round hole, and the two side walls of the upper cover key groove 122 are parallel to each other.

An upper key shaft avoiding hole 123 is further formed in the upper cover shaft sleeve 12, the upper key shaft avoiding hole 123 is matched with a corresponding adaptation section on the key shaft 41, the upper key shaft avoiding hole 123 and the upper cover shaft hole 121 are coaxial, the upper key shaft avoiding hole 123 resembles a semicircular hole and allows the key shaft 41 to rotate within a set range of rotation angles, the upper key shaft avoiding hole 123 can also be used for allowing a key at corresponding positions in the circumferential direction of the key shaft 41 to pass through when the key shaft 41 is installed or removed, the diameter of the upper key shaft avoiding hole 123 is larger than that of the upper cover shaft hole 121, and the diameter of the upper key shaft avoiding hole 123 is slightly larger than the maximum outer diameter of the key at the corresponding position on the key shaft 41, so that the key at the corresponding position on the key shaft 41 does not interfere with the upper key shaft avoiding hole 123 when they rotate relative to each other.

An upper first rotation limiting portion 124 and an upper second rotation limiting portion 125 are further formed in the upper key shaft avoiding hole 123, and the upper first rotation limiting portion 124 and the upper second rotation limiting portion 125 are used for limiting the relative rotating angle, the rotating starting position and the rotating ending position between the upper cover 1 and the key shaft 41, the upper first rotation limiting portion 124 is located at a position of 0 degrees in a circumferential direction of the upper key shaft avoiding hole 123, the upper second rotation limiting portion 125 is located at a position of 180 degrees in the circumferential direction of the upper key shaft avoiding hole 123, and the range of rotation angle of the upper cover 1 relative to the key shaft 41 is from 0 degrees to 180 degrees. In the embodiment, two upper cover shaft sleeves 12 are arranged, and the two upper cover shaft sleeves 12 are symmetrically distributed relative to the center line of the upper cover 1 (the center line shown in FIG. 6).

The upper cover body 11 is a shell with an opening at one end, an upper containing groove 111 is hollowed out inside the upper cover body 11, an upper cover opening end surface 112 is formed at one end of an opening of the upper cover body 11, an upper cover connecting portion 113 is formed on a surface of the upper cover opening end surface 112, and the upper cover connecting portion 113 is used for being matched with the drying support member body 31.

The lower cover 2 comprises a lower cover body 21 and a lower cover shaft sleeve 21*a*, the lower cover shaft sleeve 21*a* is provided on one side wall of the lower cover body 21 and is fixedly connected with the lower cover body 21 or integrally formed with the lower cover body 21, and the lower cover body 21 is sleeved on the key shaft 41 via the lower cover shaft sleeve 21*a*; and a lower cover shaft hole 221 matched with the shaft body 410 of the key shaft 41 is formed in the lower cover shaft sleeve 21*a*, so that the lower cover body 21 is rotatably connected with the key shaft 41, a lower cover key groove 222 is formed in an inner wall of the lower cover shaft hole 221 in the circumferential 90 degree position of the lower cover shaft hole 221, the lower cover key groove 222 is communicated with the lower cover shaft hole 221, and the lower cover key groove 222 is used for allowing a key at the 90 degree circumferential position of the key shaft 41 to pass through when the key shaft 41 is installed or removed.

The lower cover key groove 222 is enclosed by two side walls and one top wall, the top wall of the lower cover key groove 222 is a part of the inner wall of one round hole, and the two side walls of the lower cover key groove 222 are parallel to each other; and a lower key shaft avoiding hole 223 is further formed in the lower cover shaft sleeve 21*a*, the lower key shaft avoiding hole 223 is matched with a corresponding adaptation section on the key shaft 41, the lower key shaft avoiding hole 223 and the lower cover shaft hole 221 are coaxial, the lower key shaft avoiding hole 223 resembles a semicircular hole and allows the key shaft 41 to rotate within a set range of rotation angles, the lower key shaft avoiding hole 223 can also be used for allowing a key at corresponding positions in the circumferential direction of the key shaft 41 to pass through when the key shaft 41 is installed or removed, the diameter of the lower key shaft avoiding hole 223 is larger than that of the lower cover shaft hole 221, and the diameter of the lower key shaft avoiding hole 223 is slightly larger than the maximum outer diameter of the key at the corresponding position on the key shaft 41, so that the key shaft 41 does not interfere with the lower key shaft avoiding hole 223 when they rotate relative to each other.

A lower first rotation limiting portion 224 and a lower second rotation limiting portion 225 are further formed in the lower key shaft avoiding hole 223, and the lower first rotation limiting portion 224 and the lower second rotation limiting portion 225 are used for limiting the relative rotating angle, the rotating starting position and the rotating ending position between the lower cover 2 and the key shaft 41, the lower first rotation limiting portion 224 is located at a position of 0 degrees in a circumferential direction of the lower key shaft avoiding hole 223, the lower second rotation limiting portion 225 is located at a position of 180 degrees in the circumferential direction of the lower key shaft avoiding hole 223, and the range of rotation angle of the lower cover 2 relative to the key shaft 41 is from 0 degrees to 180 degrees. In the embodiment, four lower cover shaft sleeves 21*a* are arranged, which include two outer lower cover shaft sleeves 22 and two inner lower cover shaft sleeves 23, the two inner lower cover shaft sleeves 23 are located near the center line of the lower cover 2 and are symmetrically arranged relative to the center line of the lower cover 2 (the center line shown in FIG. 6), and the two outer lower cover shaft sleeves 22 are positioned away from the center line of the lower cover 2 and are also symmetrically arranged relative to the center line of the lower cover 2.

The lower cover body 21 is a shell with an opening at one end, a lower containing groove 211 is hollowed out inside the lower cover body 21, a lower cover opening end surface 212 is formed at one end of an opening of the lower cover body 21, a lower cover connecting portion 213 is formed on a surface of the lower cover opening end surface 212, and the lower cover connecting portion 213 is used for being matched with the drying support member body 31.

The drying support member 3 comprises a drying support member body 31 and a drying support member shaft sleeve 32, the drying support member shaft sleeve 32 is arranged at one end of the drying support member body 31 and is fixedly connected with the drying support member body 31 or integrally formed with the drying support member body 31, and the drying support member body 31 is sleeved on the key shaft via the drying support member shaft sleeve 32.

A drying support member shaft hole 321 matched with the key shaft 41 is formed in the drying support member shaft sleeve 32, an inner wall of the drying support member shaft hole 321 is provided with a plurality of drying support member key grooves 322, and each of the drying support member key grooves 322 is used for being matched with a key on a corresponding adaptation section (equivalent to the drying support member shaft sleeve adaptation section 413 to be described below) on the key shaft 41, thus enabling the key shaft 41 and the drying support member shaft sleeve 32 to rotate synchronously, which in turn causes the key shaft 41 and the drying support member body 31 to rotate synchronously; during the assembly of the storage box, the drying support member key groove 322 can also be used for allowing keys on the circumferential positions of the key shaft 41 to pass through when the key shaft 41 is installed or removed.

In the embodiment, four drying support member key grooves 322 are provided, and the four drying support member key grooves 322 are used for allowing keys at the positions of 0 degrees, 90 degrees, 180 degrees and 270 degrees in the circumferential direction of the key shaft 41 to pass through when the key shaft 41 is installed or removed; and the four drying support member key grooves 322 are evenly distributed on the circumferential inner wall of the drying support member shaft hole 321, arranged in a cross shape, and located at positions 0 degrees, 90 degrees, 180 degrees and 270 degrees in the circumferential direction of the drying support member shaft hole 321, respectively (from the perspective shown in FIG. 3). Since the key on the position of 0 degrees in the circumferential direction, of the drying support member shaft sleeve adaptation section 413 on the key shaft 41 to be described below cannot be arranged, the drying support member key grooves 322 in the position of 0 degrees in the circumferential direction of the drying support member shaft hole 321 can also not be arranged.

In this case, three drying support member key grooves 322 are provided on the drying support member shaft hole 321, located at the positions of 90 degrees, 180 degrees, and 270 degrees in the circumferential direction of the drying support member shaft hole 321. Each drying support member key groove 322 is enclosed by two side walls and one top wall, and the top wall of the drying support member key groove 322 is a part of the inner wall of one circular hole, and the two side walls of the drying support member key groove 322 are parallel to each other. In the embodiment, a drying support member shaft sleeve 32 is arranged, and the drying support member shaft sleeve 32 is located on the center line of the drying support member body 31 (the center line shown in FIG. 6).

The drying support member body 31 is a component with an opening at the upper end and the lower end, and a drying support member containing cavity 311 is hollowed out inside the drying support member body 31. A drying support member upper end surface 312 is formed at an opening in the upper end of the drying support member body 31, and the drying support member upper end surface 312 is matched with the upper cover opening end surface 112; and a drying support member upper connecting portion 313 is formed on the surface of the drying support member upper end surface 312, and the drying support member upper connecting portion 313 is matched with the upper cover connecting portion 113. A drying support member lower end surface 314 is formed at an opening in the lower end of the drying support member body 31, and the drying support member lower end surface 314 is matched with the lower cover opening end surface 212; and a drying support member lower connecting portion 315 is formed on the surface of the drying support member lower end surface 314, and the drying support member lower connecting portion 315 is matched with the lower cover connecting portion 213.

In this embodiment, the upper cover connecting portion 113 is formed by protruding out of an outer side surface of the upper cover opening end surface 112, a shape of the upper cover connecting portion 113 is a stepped boss, the upper cover connecting portion 113 comprises an upper cover connecting portion closing surface 1131 and an upper cover connecting portion transition surface 1132, and the upper cover connecting portion transition surface 1132 is connected to the upper cover connecting portion closing surface 1131 and the upper cover opening end surface 112; correspondingly, the drying support member upper connecting portion 313 is formed by recessing an outer side surface of the drying support member upper end surface 312, a shape of the drying support member upper connecting portion 313 is a stepped sinking table, the drying support member upper connecting portion 313 comprises a drying support member upper connecting portion closing surface 3131 and a drying support member upper connecting portion transition surface 3132, and the drying support member upper connecting portion transition surface 3132 is connected to the drying support member upper connecting portion closing surface 3131 and the drying support member upper end surface 312. It is understood that the upper cover connecting portion 113 can also be formed by recessing the outer side surface of the upper cover opening end surface 112, and at this time, the drying support member upper connecting portion 313 can be formed by protruding out of the outer side surface of the drying support member upper end surface 312.

In this embodiment, the lower cover connecting portion 213 is formed by protruding out of an outer side surface of the lower cover opening end surface 212, a shape of the lower cover connecting portion 213 is a stepped boss, the lower cover connecting portion 213 comprises an lower cover connecting portion closing surface 2131 and an lower cover connecting portion transition surface 2132, and the lower cover connecting portion transition surface 2132 is connected to the lower cover connecting portion closing surface 2131 and the lower cover opening end surface 212; correspondingly, the drying support member lower connecting portion 315 is formed by recessing an outer side surface of the drying support member lower end surface 314, a shape of the drying support member lower connecting portion 315 is a stepped sinking table, the drying support member lower connecting portion 315 comprises a drying support member lower connecting portion closing surface 3151 and a drying support member lower connecting portion transition surface 3152, and the drying support member lower connecting portion transition surface 3152 is connected to the drying support member lower connecting portion closing surface 3151 and the drying support member lower end surface 314. It is understood that the lower cover connecting portion 213 is formed by recessing the outer side surface of the lower cover opening end surface 212, and correspondingly, the drying support member lower connecting portion 315 is formed by protruding out of the outer side surface of the drying support member lower end surface 314.

A suspension portion 316 for hanging personal items such as breast pasties, underwear, or other private items is provided at one end of the drying support member 31 away from the drying support member shaft sleeve 32. In the embodiment, the drying support member body 31 is heart-shaped, and the suspension portion 316 is a flat-bottomed groove formed by recessing a surface of the drying support member body 31, which facilitates balancing the items and prevents them from slipping off when they are hung. Avoiding notches 33 are further formed in the two sides of the drying support member shaft sleeve 32 on the drying support member body 31, and the avoiding notches 33 are used for preventing the drying support member 3 from interfering with the upper cover 1 and the lower cover 2.

The shaft sleeve mechanism 4 comprises a key shaft 41, an upper cover shaft sleeve 12, a lower cover shaft sleeve 21*a* and a drying support member shaft sleeve 32, and the key shaft 41 is matched with the upper cover shaft sleeve 12, the lower cover shaft sleeve 21*a* and the drying support member shaft sleeve 32. The main body of the key shaft 41 is a shaft body 410 with a set length. The shaft body 410 is a cylindrical shaft body. Corresponding keys are arranged at the corresponding positions in the circumferential direction of the shaft body 410 for mating with the upper cover shaft sleeve 12, the lower cover shaft sleeve 21*a*, and the drying support member shaft sleeve 32.

Figure 18:
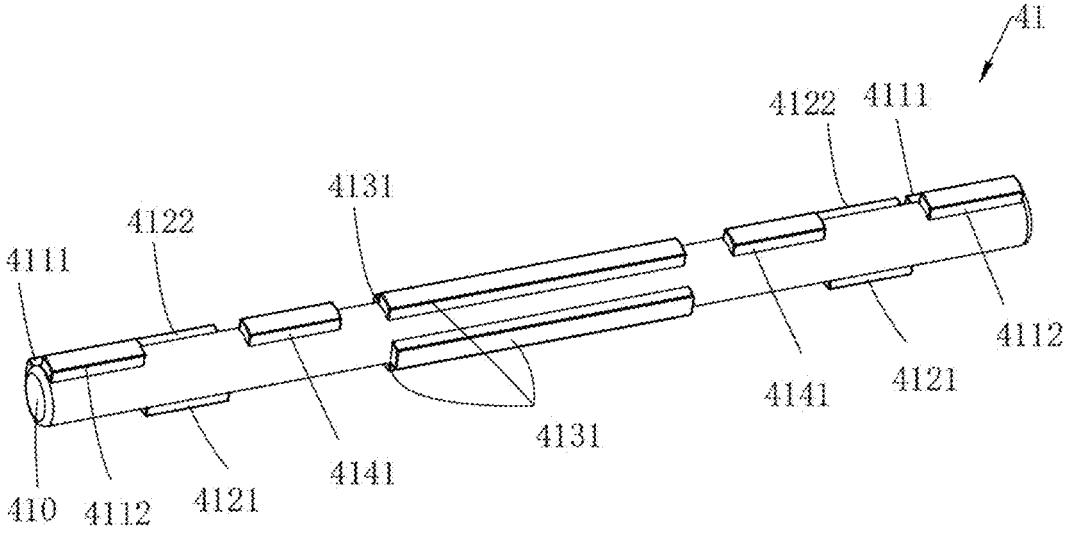
FIG. 18 is a second three-dimensional view of the key shaft of the storage box according to the present disclosure.
Figure 19A:
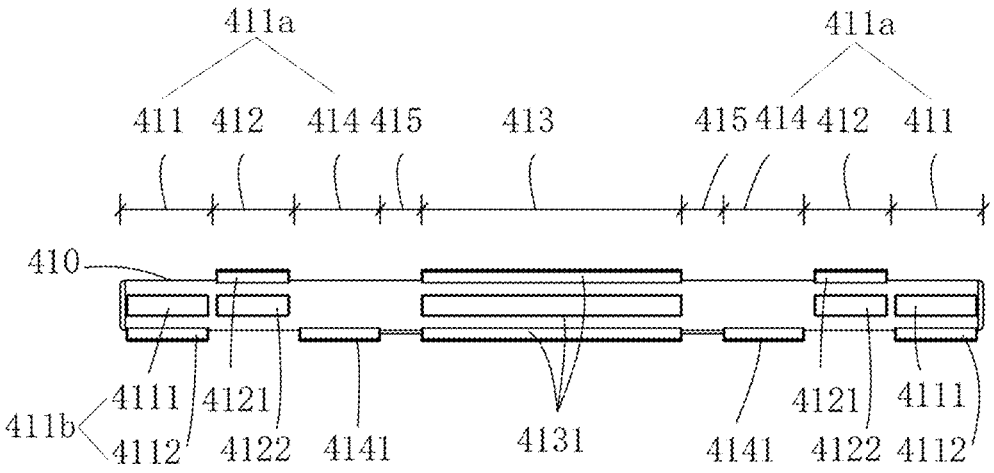
FIG. 19*a* is a front view of the key shaft of the storage box according to the present disclosure.
Figure 19B:
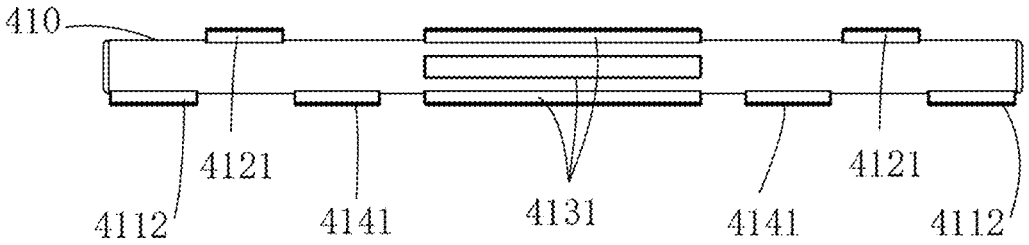
FIG. 19*b* is a rear view of the key shaft of the storage box according to the present disclosure.
Figure 19C:
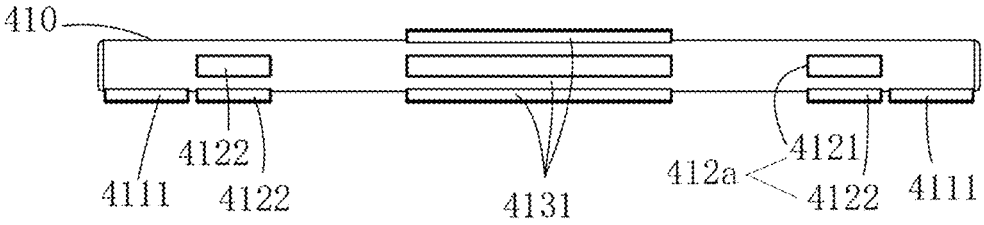
FIG. 19*c* is a top view of the key shaft of the storage box according to the present disclosure.
Figure 19D:
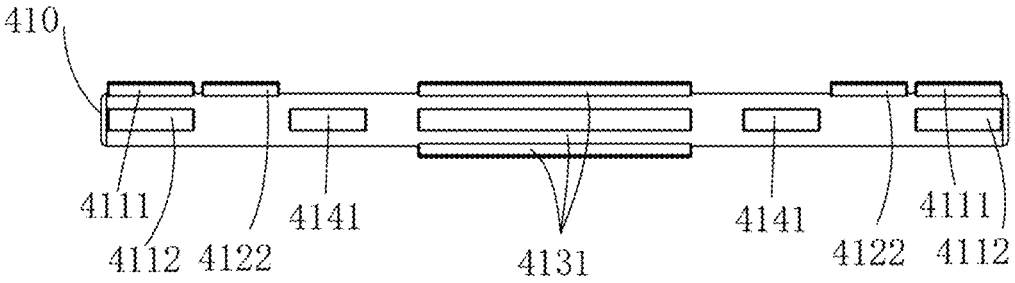
FIG. 19*d* is a bottom view of the key shaft of the storage box according to the present disclosure.
Figure 19E:
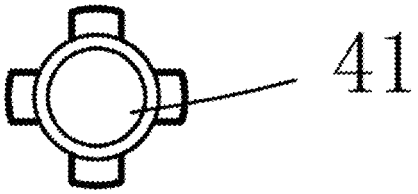
FIG. 19*e* is a left or right view of the key shaft of the storage box according to the present disclosure.

To facilitate the explanation and understanding of the transmission and mating relationship between the key shaft 41 and the upper cover shaft sleeve 12, the lower cover shaft sleeve 21*a*, and the drying support member shaft sleeve 32, the key shaft 41 can be divided into a plurality of adaptation sections. As shown in FIG. 18, in this embodiment, the key shaft 41 comprises a lower cover shaft sleeve adaptation section 411*a*, an upper cover shaft sleeve adaptation section 412, and a drying support member shaft sleeve adaptation section 413. The lower cover shaft sleeve adaptation section 411*a* is matched with the lower cover shaft sleeve 21*a*, the upper cover shaft sleeve adaptation section 412 is matched with the upper cover shaft sleeve 12, and the drying support member shaft sleeve adaptation section 413 is matched with the drying support member shaft sleeve 32. The upper cover 1 is rotatably connected to the upper cover shaft sleeve adaptation section 412 of the key shaft 41 via the upper cover shaft sleeve 12, and the lower cover 2 is rotatably connected to the lower cover shaft sleeve adaptation section 411*a* of the key shaft 41 via the lower cover shaft sleeve 21*a*, thus allowing the upper cover 1 and the lower cover 2 to be rotatably connected through the key shaft 41.

The lower cover shaft sleeve adaptation section 411*a* of the key shaft 41 comprises an outer lower cover shaft sleeve adaptation section 411 matched with the outer lower cover shaft sleeve 22, the outer lower cover shaft sleeve adaptation section 411 is provided with an outer lower cover key 411*b*, a number of the outer lower cover key 411*b* is two, the two outer lower cover keys 411*b* are respectively a first outer lower cover key 4111 and a second outer lower cover key 4112, and the two outer lower cover keys 411*b* are used for being matched with the outer lower cover shaft sleeve 22, the first outer lower cover key 4111 is located at a position of 180 degrees in a circumferential direction of the key shaft 41, and the second outer lower cover key 4112 is located at a position of 270 degrees in the circumferential direction of the key shaft 41.

The upper cover shaft sleeve adaptation section 412 is provided with an upper cover key 412*a*, a number of the upper cover key 412*a* is two, the two upper cover keys 412*a* are respectively a first upper cover key 4121 and a second upper cover key 4122, and the two upper cover keys 412*a* are used for being matched with the upper cover shaft sleeve 12, the first upper cover key 4121 is located at a position of 90 degrees in the circumferential direction of the key shaft 41, and the second upper cover key 4122 is located at a position of 180 degrees in the circumferential direction of the key shaft 41.

At least one of the drying support member key 4131 is provided on the drying support member shaft sleeve adaptation section 413, located at the circumferential positions of 90 degrees, 180 degrees, 270 degrees, or 0 degrees of the key shaft 41, and the drying support member key 4131 is used for being matched with the drying support member key groove 322 of the drying support member shaft sleeve 32.

In the embodiment, since four drying support member key grooves 322 are formed in the drying support member shaft sleeve 32, four drying support member keys 4131 are arranged on the drying support member shaft sleeve adaptation section 413 and matched with the four drying support member key grooves 322, the four drying support member keys 4131 are located at the positions of 0 degrees, 90 degrees, 180 degrees and 270 degrees in the circumferential direction of the key shaft 41 respectively, so that the key shaft 41 can drive the drying support member 3 to rotate synchronously, and the assembling structures of the four drying support member keys 4131 and the four drying support member key grooves 322 are more stable, reliable and durable. It can be understood that the drying support member key groove 322 cannot be provided at a position of 0 degrees in the circumferential direction of the drying support member shaft hole 321, and the drying support member key 4131 cannot be provided at a position of 0 degrees in the circumferential direction of the drying support member shaft sleeve adaptation section 413 of the key shaft 41. The drying support member 3 is sleeved on the drying support member shaft sleeve adaptation section 413 of the key shaft 41 via the drying support member shaft sleeve 32, and the drying support member key 4131 penetrates into the drying support member key groove 322 to form a transmission matching relationship with the drying support member key groove 322, so that the drying support member 3 and the key shaft 41 rotate synchronously.

In the embodiment, the lower cover shaft sleeve 21*a* further comprises an inner lower cover shaft sleeve 23, and correspondingly, the key shaft 41 further comprises an inner lower cover shaft sleeve adaptation section 414 matched with the inner lower cover shaft sleeve 23, so that the structure between the whole shaft sleeve mechanism 4 and the drying support member 3 is more compact, stable and durable. Correspondingly, an inner lower cover key 4141 can be provided on the inner lower cover shaft sleeve adaptation section 414 to be matched with the inner lower cover shaft sleeve 23, the inner lower cover key 4141 is located at the position of 270 degrees in the circumferential direction of the key shaft, and the other inner lower cover key can be arranged at the position, 180 degrees in the circumferential direction of the key shaft, of the inner lower cover shaft sleeve adaptation section 414. The inner lower cover key is not arranged at the position, 180 degrees in the circumferential direction of the key shaft, of the inner lower cover shaft sleeve adaptation section 414, and use is not affected. The inner lower cover shaft sleeve 23 is completely the same as the outer lower cover shaft sleeve 22, and only the inner lower cover shaft sleeve 23 is located at the position closer to the center line of the inner side of the lower cover 2. In the embodiment, the upper cover shaft sleeve 12 is located between the inner lower cover shaft sleeve 23 and the outer lower cover shaft sleeve 22, so that the structure is more compact and stable.

The storage box further comprises a handle 6. The key shaft 41 further comprises a handle adaptation section 415 for mounting the handle 6. No key is provided on the handle adaptation section 415, facilitating free rotation of the handle 6 around the key shaft 41 without being restrained by a key.

The lock box mechanism 5 comprises a lock cover buckling portion 51, a lock cover 52 and a lock cover rotating shaft portion 53, the lock cover buckling portion 51 is provided on the upper cover 1, the lock cover rotating shaft portion 53 is provided on the lower cover 2, the lock cover rotating shaft portion 53 is provided with a lock cover rotating shaft 531, and the lock cover 52 is rotatably connected to the lower cover 2 via the lock cover rotating shaft 531 on the lock cover rotating shaft portion 53. A lower portion of the lock cover 52 is provided with a lock cover rotating shaft hole 521 matched with the lock cover rotating shaft 531, and an upper portion of the lock cover 52 is provided with a lock cover buckle 522 matched with the lock cover buckling portion 51.

Figure 12:
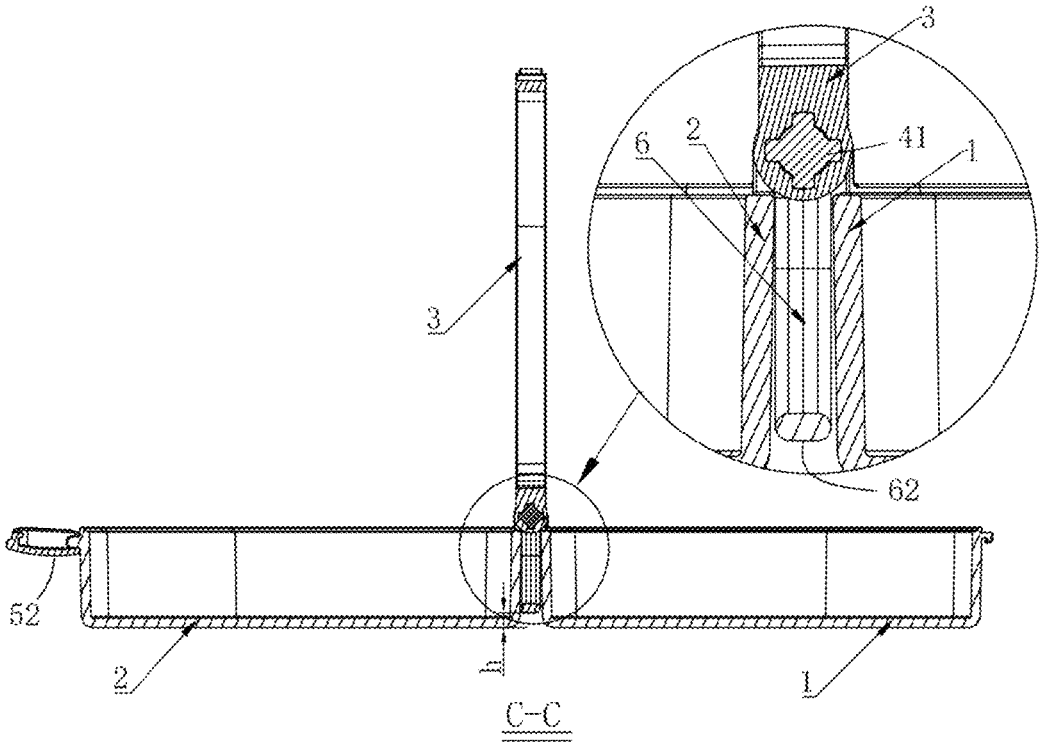
FIG. 12 is a C-C section view in a top view of a drying support member in a working state of a storage box according to the present disclosure, with a partial enlarged view in the circled area.
Figure 13:
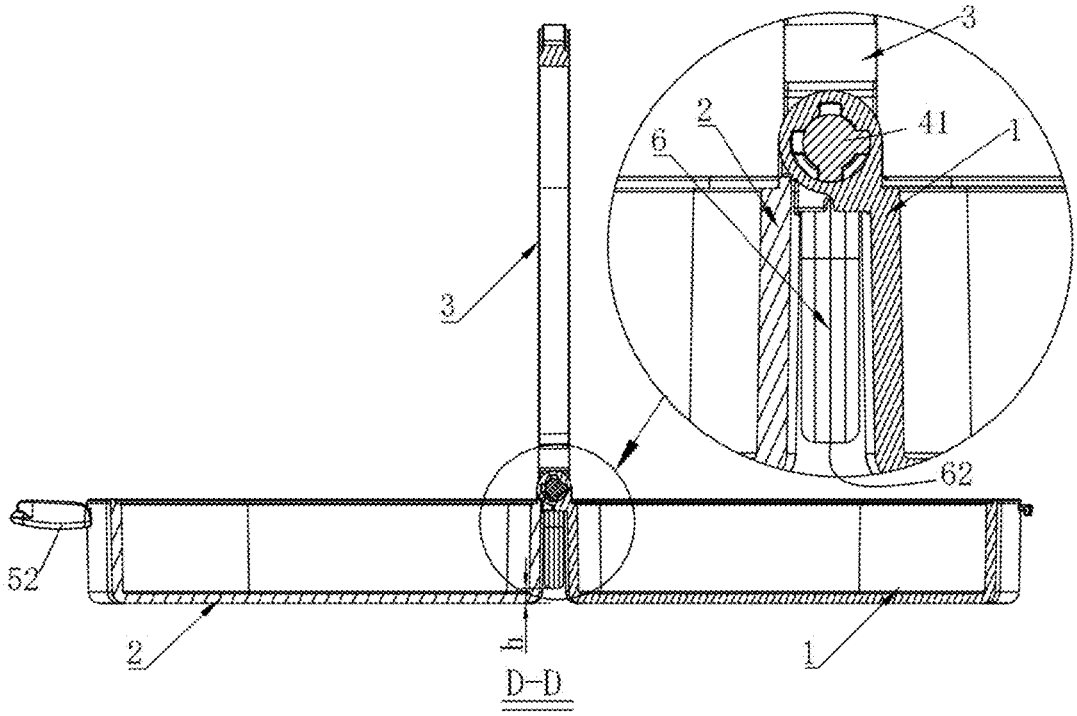
FIG. 13 is a D-D section view in a top view of a drying support member in a working state of a storage box according to the present disclosure, with partial enlarged views in the circled areas.

The handle 6 is provided with a handle shaft sleeve 61 used for sleeving the key shaft 41, a handle shaft hole 611 matched with the handle adaptation section 415 is formed in the handle shaft sleeve 61, and an inner side wall of the handle shaft hole 611 is provided with a plurality of handle key grooves 612. Each handle key groove 612 is used for allowing a key on the key shaft 41 to pass through when the key shaft 41 is installed or removed. In the embodiment, four handle key grooves 612 are formed in the inner side wall of the handle shaft hole 611, and the four handle key grooves 612 are arranged in the positions of 0 degrees, 90 degrees, 180 degrees and 270 degrees in the circumferential direction of the handle shaft hole 611 in a cross shape, so that when the handle 6 is sleeved on the key shaft 41, the handle 6 and the key shaft 41 do not interfere. The end, away from the handle shaft sleeve 61, of the handle is a free end 62. When the storage box is completely opened and the drying support member 3 is in a vertical state, the handle 6 is located in a gap between the upper cover 1 and the lower cover 2, and a set distance H (as shown in FIGS. 12 and 13) is arranged between an end surface of the free end 62 of the handle 6 and either an end surface of the upper cover or an end surface of the lower cover. This ensures that the handle does not interfere with the operation and use of the storage box.

In the embodiment, to facilitate manufacturing and ensure the entire storage box is compact, stable, reliable, and durable, the keys on the key shaft are integrally formed with the key shaft; the upper cover shaft sleeve is integrally formed with the upper cover body, the lower cover shaft sleeve is integrally formed with the lower cover body, and the drying support member body is integrally formed with the drying support member shaft sleeve.

In use, with the closed position of the storage box designated as the initial position and the lower cover 2 serving as the stationary reference, if the upper cover 1 is used to open the storage box, the angle between the upper cover 1 and the lower cover 2 is 0 degrees, and the angle between the drying support member 3 and the lower cover 2 is also 0 degrees, meaning the initial position of the drying support member 3 is horizontal.

When the upper cover 1 is opened, due to the gravity of the lower cover 2 or the presence of items such as breast pads inside, the lower cover 2 remains stationary, allowing the upper cover 1 to rotate around the key shaft 41 in the opening direction. Before the upper cover 1 reaches the critical position, the upper cover 1 does not drive the key shaft 41 to rotate due to the presence of the upper key shaft avoiding hole 123 in the upper cover shaft sleeve 12.

Figure 14:
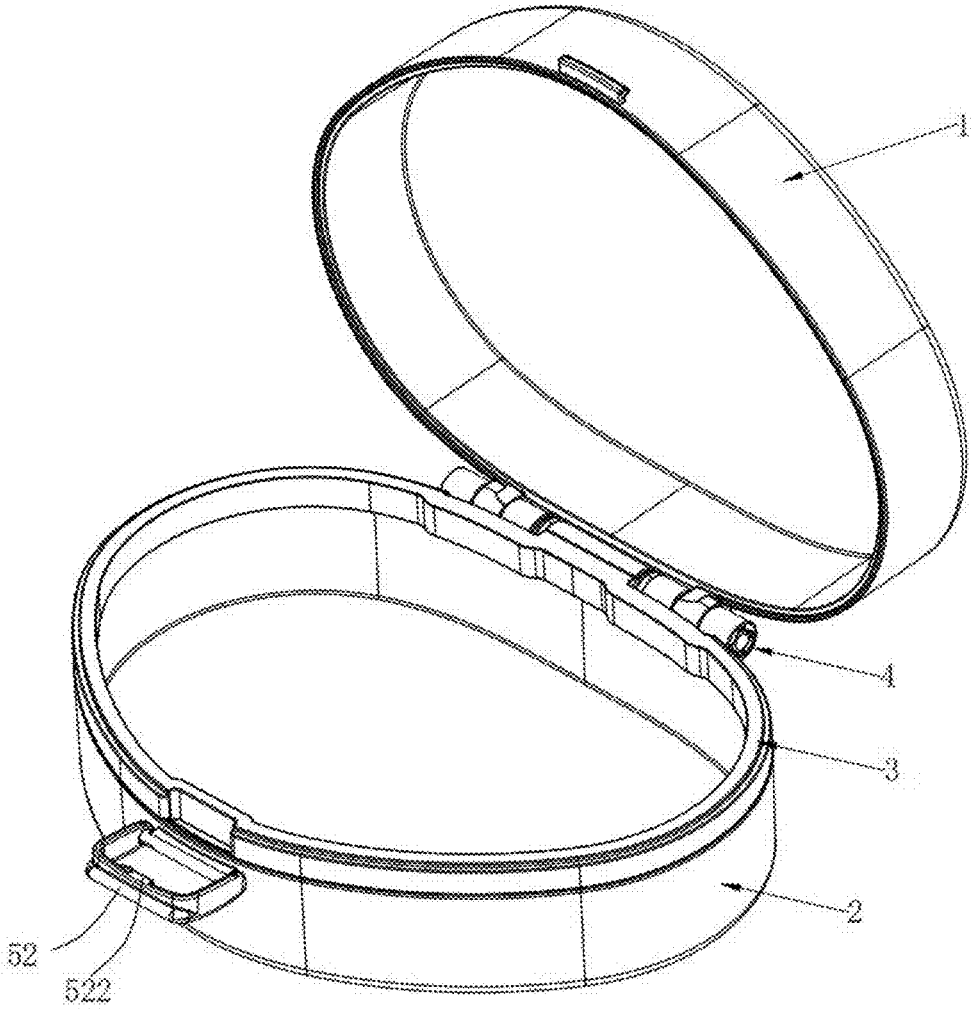
FIG. 14 is a three-dimensional view of an upper cover of the storage box being opened and a drying support member in a closed state according to the present disclosure.
Figure 15:
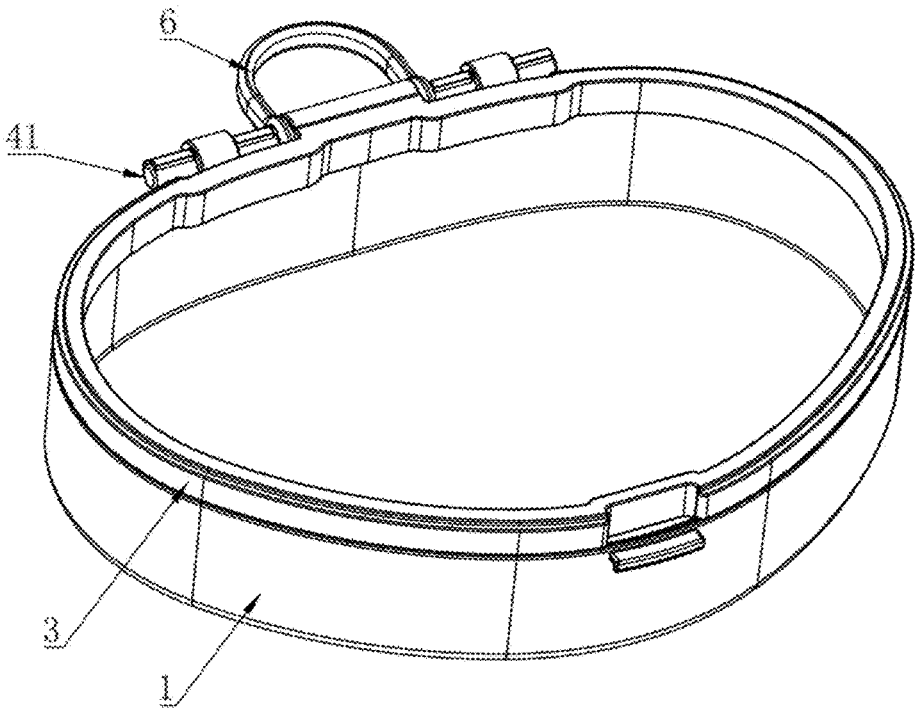
FIG. 15 is a three-dimensional view of the storage box of the present disclosure when the upper cover is removed and the drying support member in a closed state according to the present disclosure.
Figure 16:
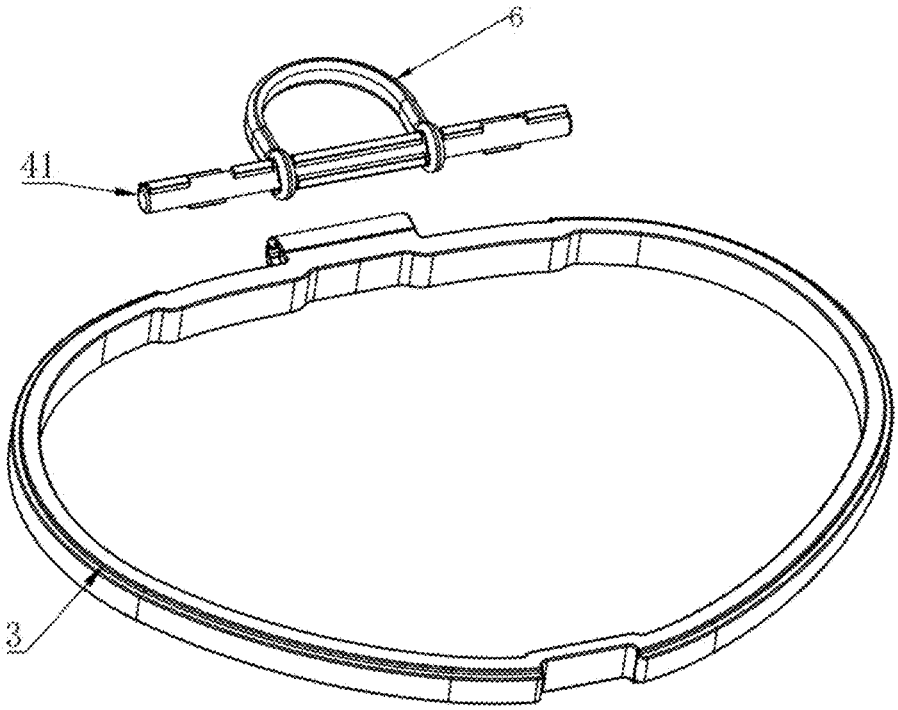
FIG. 16 is a three-dimensional view of a drying support member, a shaft sleeve mechanism and a handle of the storage box according to the present disclosure.

When the upper cover 1 reaches the critical position (as shown in FIG. 14), the angle between the upper cover 1 and the lower cover 2 is 90 degrees. If the upper cover 1 continues to rotate, it will come into contact with the first upper cover key 4121 through the upper first rotation limiting portion 124, driving the key shaft 41 to rotate and, in turn, the drying support member 3 to rotate synchronously until the upper cover 1 reaches the final position. At this point, the second outer lower cover key 4112 on the outer lower cover shaft sleeve adaptation section 411 comes into contact with the lower first rotation limiting portion 224 inside the outer lower cover shaft sleeve, stopping the rotation of the key shaft 41. The angle between the upper cover 1 and the lower cover 2 is 180 degrees, the storage box reaches its maximum opening angle, and is fully open or in the working state. Simultaneously, the drying support member 3 also rotates to its final position, with an angle of 90 degrees between the drying support member 3 and the lower cover 2 (as shown in FIG. 12 or 13). The drying support member 3 reaches its maximum opening angle, is fully open or in the working state, and is in the supporting position, i.e., it is vertical.

Due to the gravity of the upper cover 1 and the lower cover 2, there is a certain force arm and torque relative to the key shaft, and since the key shaft 41 is limited by the upper first rotation limiting portion 124 and the lower first rotation limiting portion 224, it cannot rotate freely. This also prevents the drying support member 3, which rotates synchronously with the key shaft 41, from rotating freely, keeping it stationary or in the working state in the supporting position. In other words, the drying support member 3 is vertically supported on the storage box using the shaft sleeve mechanism 4.

To return the upper cover 1 or the drying support member 3 from the final position to the initial position, i.e., to change the angle between the upper cover 1 and the lower cover 2 from 180 degrees to 0 degrees, and the angle between the drying support member 3 and the lower cover 2 from 90 degrees to 0 degrees, the upper cover 1 can be rotated around the key shaft 41 in the closing direction.

When the upper cover 1 rotates from the final position in the closing direction, it will drive the drying support member 3 to rotate. When the upper cover 1 returns to the critical position, the angle between the upper cover 1 and the lower cover 2 is 90 degrees, and the drying support member 3 rotates back to its initial or closed position, i.e., the angle between the drying support member 3 and the lower cover 2 is 0 degrees. After this, the upper cover 1 continues to rotate in the closing direction, and the drying support member 3, having already returned to its original position, remains in the closed position. When the upper cover 1 continues to rotate until the angle between the upper cover 1 and the lower cover 2 returns to 0 degrees, it returns to the initial or closed position.

Similarly, if the lower cover 2 is used to open the storage box, with the upper cover 1 serving as the stationary reference, the angle between the upper cover 1 and the lower cover 2 is 0 degrees, and the angle between the drying support member 3 and the lower cover 2 is also 0 degrees, indicating that the initial position of the drying support member 3 is horizontal.

When the lower cover 2 is opened, due to the gravity of the upper cover 1 or the presence of items such as breast pads inside, the lower cover 2 remains stationary, allowing the lower cover 2 to rotate around the key shaft 41 in the opening direction. Before the lower cover 2 reaches the critical position, the lower cover 2 does not drive the key shaft 41 to rotate due to the presence of the lower key shaft avoiding hole 223 in the lower cover shaft sleeve.

When the lower cover 2 reaches the critical position, the angle between the lower cover and the upper cover is 90 degrees. If the lower cover 2 continues to rotate, it will come into contact with the second outer lower cover key 4112 through the lower first rotation limiting portion 224, driving the key shaft 41 to rotate and, in turn, the drying support member 3 to rotate synchronously until the lower cover 2 reaches the final position. At this point, the first upper cover key 4121 on the upper cover shaft sleeve adaptation section 412 comes into contact with the upper first rotation limiting portion 124 inside the upper cover shaft sleeve 12, stopping the rotation of the key shaft 41. The angle between the lower cover 2 and the upper cover 1 is 180 degrees, the storage box reaches its maximum opening angle, and is fully open or in the working state. Simultaneously, the drying support member 3 also rotates to its final position, with an angle of 90 degrees between the drying support member 3 and the lower cover 2 (as shown in FIG. 12 or 13). The drying support member 3 reaches its maximum opening angle, is fully open or in the working state, and is in the supporting position, i.e., it is vertical.

Due to the gravity of the upper cover 1 and the lower cover 2, there is a certain force arm and torque relative to the key shaft, and since the key shaft 41 is limited by the lower first rotation limiting portion 224 and the upper first rotation limiting portion 124, it cannot rotate freely. This also prevents the drying support member 3, which rotates synchronously with the key shaft 41, from rotating freely, keeping it stationary or in the working state in the supporting position. In other words, the drying support member 3 is vertically supported on the storage box using the shaft sleeve mechanism 4.

To return the lower cover 2 or the drying support member 3 from the final position to the initial position, i.e., to change the angle between the lower cover 2 and the upper cover 1 from 180 degrees to 0 degrees, and the angle between the drying support member 3 and the upper cover 1 from 90 degrees to 0 degrees, the lower cover 2 can be rotated around the key shaft 41 in the closing direction.

When the lower cover 2 rotates from the final position, it will drive the drying support member 3 to rotate. When the lower cover 2 returns to the critical position, the angle between the lower cover 2 and the upper cover 1 is 90 degrees, and the drying support member 3 rotates back to its initial or closed position, i.e., the angle between the drying support member 3 and the upper cover 1 is 0 degrees. After this, the lower cover 2 continues to rotate in the closing direction, and the drying support member 3, having already returned to its original position, remains in the closed position. When the lower cover 2 continues to rotate until the angle between the lower cover 2 and the upper cover 1 returns to 0 degrees, it returns to the initial or closed position.

It should be noted that if the angle between the upper cover 1 and the lower cover 2 does not exceed 90 degrees when opening the storage box, the drying support member 3 remains in its closed position, which does not interfere with the removal or placement of breast pasties or other items in the storage box.

There are numerous other ways to form new embodiments and new structural features by mutually substituting, combining, and making adaptive changes among the various structural features described in the aforementioned embodiments and within each embodiment, which will not be further elaborated here.

It should be understood that the orientations or positional relationships indicated by the terms "length", "width", "upper", "lower", "front", "rear", "left", "right", "vertical", "horizontal", "top", "bottom", "inner", "outer", etc. are based on the orientations or positional relationships shown in the drawings. They are merely intended to facilitate describing the present disclosure and simplify the description, rather than indicating or implying that the device or element referred to must have a specific orientation, and is constructed and operated in a specific orientation, and therefore cannot be understood as a limitation to the present disclosure. In the present disclosure, unless otherwise specified, directional terms such as front, rear, left, right, up, or upper and lower are based on the perspective of the patented product as shown in FIG. 3 of the accompanying drawings. Additionally, unless otherwise specified, the circumferential angles of circular or cylindrical components or parts, including key shafts, rotating shafts, various holes, shaft sleeves, and shaft holes, are referenced to the perspective of the product as shown in FIG. 3. The 0 degree, 90 degrees, 180 degree, and 270 degree positions of the circumferential angles are indicated in the top-left corner of FIG. 3.

The terms "first" and "second" are used for descriptive purposes only and cannot be understood as indicating or implying relative importance or implicitly indicating the quantity of indicated technical features. Therefore, the features defined with "first" and "second" may explicitly or implicitly include one or more of such features. In the description of the present disclosure, "a plurality of" means two or more, unless otherwise specified.

In the present disclosure, unless otherwise specified and limited, terms such as "installed", "connected with", "connected to", "fixed", etc., should be understood in a broad sense. For example, they can be fixedly connected or detachably connected or integrally connected; and they can be directly connected or indirectly connected through an intermediate medium, and can be communicated in the inner portion of the two elements. For those of ordinary skill in the art, the specific meanings of the above terms in the present disclosure may be understood according to specific situations.

In the present disclosure, unless otherwise specified and limited, the first feature "on" or "under" the second feature may include direct contact between the first feature and the second feature, or may include that the first feature and the second feature are not in direct contact but are in contact with another feature therebetween. Furthermore, the first feature is "above", "over" and "upper" the second feature, including the first feature being directly above and obliquely above the second feature, or merely indicating that the horizontal height of the first feature is less than that of the second feature. The first feature is "below", "underneath" and "underneath" the second feature, including the first feature being directly above and obliquely above the second feature, or merely indicating that the horizontal height of the first feature is less than that of the second feature.

In the description of this specification, reference terms such as "an embodiment", "some embodiments" "example", "specific example" or "some examples" imply that the specific features, structures, materials, or characteristics described in conjunction with that embodiment or example are included in at least one embodiment or example of the present disclosure. In this specification, the schematic representation of the above terms does not necessarily refer to the same embodiment or example. Furthermore, the particular features, structures, materials, or characteristics may be combined in any suitable manner in one or more embodiments or examples.

The storage box provided by the present disclosure has been introduced in detail above. Specific examples have been used in this text to explain the principles and embodiments of the present disclosure. The explanation of the above embodiments is only intended to help understand the core idea of the present disclosure. At the same time, for those of ordinary skill in the art, based on the ideas and methods of the present disclosure, there may be variations in the specific embodiments and scope of application. In summary, the content of this specification should not be construed as limiting the present disclosure.

What is claimed is:

1. A storage box, comprising an upper cover and a lower cover, wherein the storage box further comprises a drying support member and a shaft sleeve mechanism, and the shaft sleeve mechanism comprises a key shaft, an upper cover shaft sleeve, a lower cover shaft sleeve and a drying support member shaft sleeve;

the upper cover shaft sleeve, the lower cover shaft sleeve and the drying support member shaft sleeve are matched with the key shaft, the key shaft comprises a lower cover shaft sleeve adaptation section, an upper cover shaft sleeve adaptation section and a drying support member shaft sleeve adaptation section, the lower cover shaft sleeve adaptation section is matched with the lower cover shaft sleeve, the upper cover shaft sleeve adaptation section is matched with the upper cover shaft sleeve, and the drying support member shaft sleeve adaptation section is matched with the drying support member shaft sleeve;

the upper cover is provided with the upper cover shaft sleeve, the upper cover is rotatably connected to the upper cover shaft sleeve adaptation section of the key shaft via the upper cover shaft sleeve, the lower cover is provided with the lower cover shaft sleeve, the lower cover is rotatably connected to the lower cover shaft sleeve adaptation section of the key shaft via the lower cover shaft sleeve, the drying support member is provided with the drying support member shaft sleeve, the drying support member is connected to the drying support member shaft sleeve adaptation section of the key shaft via the drying support member shaft sleeve, and the drying support member and the key shaft rotate synchronously;

when the storage box is in a closed position, the drying support member is located between the upper cover and the lower cover, and an upper end of the drying support member is connected with the upper cover, and a lower end of the drying support member is connected with the lower cover; and when the drying support member is in a working state, the drying support member is vertically supported on the storage box.

2. The storage box according to claim 1, wherein an upper cover shaft hole matched with the key shaft is formed in the upper cover shaft sleeve, an upper key shaft avoiding hole coaxial with the upper cover shaft hole is further formed in the upper cover shaft sleeve, and an upper first rotation limiting portion and an upper second rotation limiting portion are formed in the upper key shaft avoiding hole;

a lower cover shaft hole matched with the key shaft is formed in the lower cover shaft sleeve, a lower key shaft avoiding hole coaxial with the lower cover shaft hole is further formed in the lower cover shaft sleeve, and a lower first rotation limiting portion and a lower second rotation limiting portion are formed in the lower key shaft avoiding hole; and a drying support member shaft hole matched with the key shaft is formed in the drying support member shaft sleeve.

3. The storage box according to claim 2, wherein an inner wall of the upper cover shaft hole is provided with an upper cover key groove, an inner wall of the lower cover shaft hole is provided with a lower cover key groove, and an inner wall of the drying support member shaft hole is provided with a plurality of drying support member key grooves.

4. The storage box according to claim 3, wherein the upper first rotation limiting portion is located at a position of 0 degrees in a circumferential direction of the upper key shaft avoiding hole, and the upper second rotation limiting portion is located at a position of 180 degrees in the circumferential direction of the upper key shaft avoiding hole;

the lower first rotation limiting portion is located at a position of 0 degrees in a circumferential direction of the lower key shaft avoiding hole, and the lower second rotation limiting portion is located at a position of 180 degrees in the circumferential direction of the lower key shaft avoiding hole;

the upper cover key groove is located at a position of 270 degrees in a circumferential direction of the upper cover shaft hole, and the lower cover key groove is located at a position of 90 degrees in the circumferential direction of the lower cover shaft hole;

a number of the drying support member key grooves is three, the three drying support member key grooves are located at positions of 90 degrees, 180 degrees and 270 degrees in a circumferential direction of the drying support member shaft hole respectively; or, a number of the drying support member key grooves is four, the four drying support member key grooves are located at positions of 90 degrees, 180 degrees, 270 degrees and 0 degrees in the circumferential direction of the drying support member shaft hole respectively.

5. The storage box according to claim 1, wherein the lower cover shaft sleeve comprises an outer lower cover shaft sleeve, and correspondingly, the lower cover shaft sleeve adaptation section comprises an outer lower cover shaft sleeve adaptation section matched with the outer lower cover shaft sleeve, the outer lower cover shaft sleeve adaptation section is provided with an outer lower cover key, a number of the outer lower cover key is two, the two outer lower cover keys are used for being matched with the outer lower cover shaft sleeve, and the two outer lower cover keys are respectively a first outer lower cover key and a second outer lower cover key;

the upper cover shaft sleeve adaptation section is provided with an upper cover key, a number of the upper cover key is two, the two upper cover keys are used for being matched with the upper cover shaft sleeve, and the two upper cover keys are respectively a first upper cover key and a second upper cover key; and the drying support member shaft sleeve adaptation section is provided with at least one drying support member key, and the drying support member key is used for being matched with the drying support member shaft sleeve.

6. The storage box according to claim 5, wherein the first outer lower cover key is located at a position of 180 degrees in a circumferential direction of the key shaft, and the second outer lower cover key is located at a position of 270 degrees in the circumferential direction of the key shaft;

the first upper cover key is located at a position of 90 degrees in the circumferential direction of the key shaft, and the second upper cover key is located at a position of 180 degrees in the circumferential direction of the key shaft; and at least one of the drying support member key is provided on the drying support member shaft sleeve adaptation section, located at the circumferential positions of 90 degrees, 180 degrees, 270 degrees, or 0 degrees of the key shaft.

7. The storage box according to claim 5, wherein the lower cover shaft sleeve further comprises an inner lower cover shaft sleeve, and the key shaft further comprises an inner lower cover shaft sleeve adaptation section matched with the inner lower cover shaft sleeve.

8. The storage box according to claim 7, wherein the inner lower cover shaft sleeve adaptation section is provided with an inner lower cover key, and the inner lower cover key is located at the position of 270 degrees in the circumferential direction of the key shaft.

9. The storage box according to claim 1, wherein the key shaft further comprises a handle adaptation section, and the storage box further comprises a handle; and the handle is provided with a handle shaft sleeve, the handle shaft sleeve is rotatably connected to the handle adaptation section, a handle shaft hole matched with the handle adaptation section is formed in the handle shaft sleeve, and an inner side wall of the handle shaft hole is provided with a plurality of handle key grooves.

10. The storage box according to claim 9, wherein when the storage box is completely opened and the drying support member is in a supporting state, the handle is located in a gap between the upper cover and the lower cover, and a set distance is arranged between an end surface of a free end of the handle and either an end surface of the upper cover or an end surface of the lower cover.

11. The storage box according to claim 1, wherein a suspension portion is provided at one end of the drying support member away from the drying support member shaft sleeve.

12. The storage box according to claim 11, wherein the suspension portion is a flat-bottomed groove, and the flat-bottomed groove is formed by recessing a surface of the drying support member.

13. The storage box according to claim 1, wherein the upper cover further comprises an upper cover body, the upper cover shaft sleeve is provided on the upper cover body, the lower cover further comprises a lower cover body, the lower cover shaft sleeve is provided on the lower cover body, the drying support member further comprises a drying support member body, and the drying support member shaft sleeve is provided on the drying support member body.

14. The storage box according to claim 13, wherein an upper cover opening end surface is formed on the upper cover body, an upper cover connecting portion is formed on a surface of the upper cover opening end surface, and the upper cover connecting portion is used for being matched with the drying support member body;

a lower cover opening end surface is formed on the lower cover body, a lower cover connecting portion is formed on a surface of the lower cover opening end surface, and the lower cover connecting portion is used for being matched with the drying support member body;

a drying support member upper end surface is formed on the drying support member body, and the drying support member upper end surface is matched with the upper cover opening end surface; and a drying support member lower end surface is further formed on the drying support member body, and the drying support member lower end surface is matched with the lower cover opening end surface.

15. The storage box according to claim 14, wherein the upper cover connecting portion is formed by protruding out of an outer side surface of the upper cover opening end surface, and a shape of the upper cover connecting portion is a stepped boss;

correspondingly, a drying support member upper connecting portion is formed by recessing an outer side surface of the drying support member upper end surface, and a shape of the drying support member upper connecting portion is a stepped sinking table;

the lower cover connecting portion is formed by protruding out of an outer side surface of the lower cover opening end surface, and a shape of the lower cover connecting portion is a stepped boss; and correspondingly, a drying support member lower connecting portion is formed by recessing an outer side surface of the drying support member lower end surface, and a shape of the drying support member lower connecting portion is a stepped sinking table.

16. The storage box according to claim 15, wherein the upper cover connecting portion comprises an upper cover connecting portion closing surface and an upper cover connecting portion transition surface, and the upper cover connecting portion transition surface is connected to the upper cover connecting portion closing surface and the upper cover opening end surface;

the drying support member upper connecting portion comprises a drying support member upper connecting portion closing surface and a drying support member upper connecting portion transition surface, and the drying support member upper connecting portion transition surface is connected to the drying support member upper connecting portion closing surface and the drying support member upper end surface;

the lower cover connecting portion comprises a lower cover connecting portion closing surface and a lower cover connecting portion transition surface, and the lower cover connecting portion transition surface is connected to the lower cover connecting portion closing surface and the lower cover opening end surface; and the drying support member lower connecting portion comprises a drying support member lower connecting portion closing surface and a drying support member lower connecting portion transition surface, and the drying support member lower connecting portion transition surface is connected to the drying support member lower connecting portion closing surface and the drying support member lower end surface.

17. The storage box according to claim 1, wherein the storage box further comprises a lock box mechanism, the lock box mechanism comprises a lock cover buckling portion, a lock cover and a lock cover rotating shaft portion, the lock cover buckling portion is provided on the upper cover, the lock cover rotating shaft portion is provided on the lower cover, and the lock cover is rotatably connected to the lower cover via the lock cover rotating shaft portion; and the lock cover rotating shaft portion is provided with a lock cover rotating shaft, a lower portion of the lock cover is provided with a lock cover rotating shaft hole matched with the lock cover rotating shaft, and an upper portion of the lock cover is provided with a lock cover buckle matched with the lock cover buckling portion.

* * * * *